US011772291B2

(12) United States Patent
Hahn et al.

(10) Patent No.: US 11,772,291 B2
(45) Date of Patent: Oct. 3, 2023

(54) TRIMMER RAZOR WITH CAM TRACK

(71) Applicant: Leaf Shave Company, Pittsburgh, PA (US)

(72) Inventors: Adam J. Hahn, Pittsburgh, PA (US); Adam Simone, Pittsburgh, PA (US)

(73) Assignee: Leaf Shave Company, Pittsburgh, PA (US)

( * ) Notice: Subject to any disclaimer, the term of this patent is extended or adjusted under 35 U.S.C. 154(b) by 162 days.

(21) Appl. No.: 17/205,569

(22) Filed: Mar. 18, 2021

(65) Prior Publication Data

US 2021/0299896 A1 Sep. 30, 2021

Related U.S. Application Data

(60) Provisional application No. 62/994,107, filed on Mar. 24, 2020.

(51) Int. Cl.
*B26B 21/16* (2006.01)
*B26B 21/40* (2006.01)
*B26B 21/52* (2006.01)

(52) U.S. Cl.
CPC ..... *B26B 21/16* (2013.01); *B26B 21/4012* (2013.01); *B26B 21/521* (2013.01)

(58) Field of Classification Search
CPC ..... B26B 21/14; B26B 21/16; B26B 21/18; B26B 21/4012; B26B 21/4068; B26B 21/4075; B26B 21/52; B26B 21/521
USPC ..... 30/47–51, 526
See application file for complete search history.

(56) References Cited

U.S. PATENT DOCUMENTS 344,115 A * 6/1886 Kampfe ..... B26B 21/52 30/47
927,588 A * 7/1909 O'Neill ..... B26B 21/16 30/83
956,532 A 5/1910 Kieselhorst
985,089 A * 2/1911 Winn ..... B26B 21/16 30/526

(Continued)

FOREIGN PATENT DOCUMENTS

GB 171304 11/1921
WO 2018152387 A1 8/2018

OTHER PUBLICATIONS

"The Beluga Razor: A Barber Quality Shave . . . Minus the Barber"; Beluga Shave Co., https://www.kickstarter.com/projects/257125380/the-beluga-razor-a-barber-quality-shaveminus-the-b?ref=nav_search, 22 pages, Oct. 14, 2014.

*Primary Examiner* — Jason Daniel Prone
(74) *Attorney, Agent, or Firm* — THE WEBB LAW FIRM

(57) ABSTRACT

A trimmer razor includes a handle, a head operatively connected to the handle, the head including a base member defining a cam track, a seat extending from the base member, and a cover connected to the seat; and an extension arrangement connecting the cover to the handle so that upon rotation of the handle, the cover is movable between an open position in which the cover is spaced from the seat and a closed position in which the cover is clamped to the seat, wherein the extension arrangement includes a rod connected to the cover and a cam pin extending from the rod, and wherein the cam pin is configured to follow the cam track so that when the cover moves from the closed position to the open position, the cover rotates relative to the seat.

6 Claims, 34 Drawing Sheets

(56) References Cited

U.S. PATENT DOCUMENTS 1,008,719 A * 11/1911 Kampfe ..... B26B 21/20 30/49
1,060,657 A 5/1913 Alter
1,159,487 A 11/1915 Fuller
1,205,187 A 11/1916 Fuller
1,206,315 A 11/1916 Ehrlich
1,220,837 A 3/1917 Fuller
1,290,018 A * 12/1918 Goodwin ..... B26B 21/52 30/59
1,365,212 A * 1/1921 Walker et al. ..... B26B 21/16 30/526
1,367,158 A 2/1921 McAuliffe
1,411,287 A 4/1922 McAuliffe
1,482,371 A 1/1924 Witter
1,492,246 A 4/1924 Gaisman
1,497,030 A 6/1924 Salerni
1,522,716 A 1/1925 Frank
1,548,471 A 8/1925 Kepka
1,550,861 A 8/1925 Wolcott
1,552,234 A 9/1925 Roebuck
1,562,445 A * 11/1925 Gaisman ..... B26B 21/18 30/526
1,565,142 A * 12/1925 Coryell ..... A45D 40/06 30/47
1,581,469 A 4/1926 Oskin
1,633,139 A 6/1927 Staats-oels
1,635,827 A 7/1927 Frank
1,694,337 A 12/1928 Oberheim
1,710,548 A 4/1929 Minahan
1,719,675 A 7/1929 Sirch
1,734,524 A 11/1929 Kohlmiller
1,744,752 A 1/1930 Crespo
1,798,447 A * 3/1931 Behrman ..... B26B 21/16 30/526
1,805,895 A 5/1931 Watson
1,807,342 A * 5/1931 Pelosi ..... B26B 21/16 30/76
1,826,410 A 10/1931 Aronson
1,853,839 A 4/1932 Wolcott
1,859,555 A 5/1932 De Haven
1,871,789 A 8/1932 Green
1,883,131 A * 10/1932 Tua ..... B26B 21/18 30/67
1,885,814 A * 11/1932 Flagg ..... B26B 21/18 30/41
1,887,911 A 11/1932 Aronson
1,901,591 A 3/1933 Godshalk
1,905,331 A 4/1933 Aronson
1,907,783 A 5/1933 Gaisman
1,914,630 A 6/1933 Aronson
1,920,711 A 8/1933 Pelizzola
1,929,463 A 10/1933 Wolcott
1,932,386 A 10/1933 Aronson
1,952,253 A 3/1934 Hoff
1,952,370 A * 3/1934 Garretson ..... B26B 21/18 30/72
1,953,248 A * 4/1934 McAdoo ..... B26B 21/18 30/70
1,954,259 A 4/1934 Norviel
1,959,841 A 5/1934 Sage
1,960,406 A * 5/1934 Blake ..... B26B 21/16 30/51
1,965,348 A 7/1934 Lucia
1,966,425 A 7/1934 Aronson
1,966,426 A 7/1934 Aronson
1,976,987 A * 10/1934 Gardner et al. ..... B26B 21/16 30/51
1,978,988 A 10/1934 Cook et al.
1,998,200 A * 4/1935 McDowell ..... B26B 21/18 30/65
2,001,155 A 5/1935 Peters
2,001,198 A * 5/1935 Klegman ..... B26B 21/18 30/58
2,004,086 A 6/1935 Testi
2,018,042 A 10/1935 Thompson
2,020,500 A * 11/1935 Garretson ..... B26B 21/18 30/60.5
2,026,125 A 12/1935 Godshalk et al.
2,048,868 A 7/1936 Johnston
2,061,720 A * 11/1936 Testi ..... B26B 21/18 30/75
2,062,683 A 12/1936 Smith
2,090,968 A 8/1937 Testi
2,103,924 A 12/1937 Young
2,113,772 A * 4/1938 Rothschild et al. .... B26B 21/24 30/40
2,115,792 A * 5/1938 Steinmetz et al. ..... B26B 21/24 30/51
2,121,000 A 6/1938 Anderson
2,125,135 A 7/1938 Trippe
2,143,276 A * 1/1939 Martin ..... B26B 21/18 30/60.5
2,176,887 A * 10/1939 Carlson ..... B26B 21/18 30/59
2,210,767 A * 8/1940 McGown ..... B26B 21/18 30/68
2,225,020 A * 12/1940 Rojahn ..... B26B 21/18 30/60.5
2,252,499 A 8/1941 Flaws, Jr.
2,252,569 A 8/1941 Kennison
2,290,964 A 7/1942 Hill
2,319,488 A 5/1943 Burchett
2,397,555 A 4/1946 Lotthamer
2,429,334 A 10/1947 Smith
2,458,257 A 1/1949 Donovan
2,565,281 A 8/1951 Thomas
2,569,167 A * 9/1951 Hellmann ..... B26B 21/18 30/73
2,581,214 A 1/1952 Stegner
2,602,220 A 7/1952 Ewing
2,602,221 A 7/1952 Ewing et al.
2,632,243 A * 3/1953 Hellmann ..... B26B 21/18 30/526
2,640,258 A 6/1953 Eckert
2,644,229 A * 7/1953 Muros ..... B26B 21/18 30/526
2,735,174 A * 2/1956 Gyllenberg ..... B26B 21/18 30/49
2,769,232 A 11/1956 Leonard, Sr.
2,780,866 A 2/1957 Borden
2,787,921 A 4/1957 Blankenship
2,804,685 A * 9/1957 Peters, Jr. ..... B26B 21/22 30/50
2,839,829 A 6/1958 Knapp
2,911,712 A 11/1959 Choclin et al.
3,057,062 A 10/1962 Mashiba
3,080,651 A 3/1963 La Cas
3,101,536 A 8/1963 Bringewald
3,167,888 A 2/1965 Shanley
3,199,252 A 8/1965 Hanchey
3,491,442 A * 1/1970 Kuhnl ..... B26B 21/32 30/61
3,651,568 A 3/1972 Barry et al.
3,653,123 A 4/1972 King et al.
3,777,396 A 12/1973 Simonetti
3,786,563 A 1/1974 Dorion, Jr. et al.
3,950,849 A 4/1976 Perry
3,964,159 A 6/1976 Ferraro
4,083,103 A * 4/1978 Estandian ..... B26B 21/52 30/47
4,265,055 A 5/1981 Cartwright et al.
4,288,920 A 9/1981 Douglass et al.
4,345,374 A 8/1982 Jacobson
4,409,735 A 10/1983 Cartwright et al.
4,485,554 A 12/1984 Bergamaschi
4,608,782 A 9/1986 Chylinski
4,715,120 A 12/1987 McGready
4,807,401 A 2/1989 Atwater
4,860,449 A 8/1989 Duncan
5,036,731 A 8/1991 Fletcher
5,139,138 A 8/1992 Isaksen
5,333,382 A 8/1994 Buchbinder

(56) References Cited

U.S. PATENT DOCUMENTS

| | | | | |
|---|---|---|---|---|
| 5,522,137 | A | 6/1996 | Andrews | |
| 5,848,475 | A | 12/1998 | Hill et al. | |
| 6,164,290 | A | 12/2000 | Andrews | |
| 6,385,850 | B1 | 5/2002 | Coulthard, Jr. | |
| 6,449,848 | B1 | 9/2002 | Hackerman | |
| 6,694,618 | B1 | 2/2004 | de Villiers | |
| 6,772,523 | B1 | 8/2004 | Richard et al. | |
| 6,807,739 | B2 | 10/2004 | Follo | |
| 7,104,874 | B1 | 9/2006 | Gussack et al. | |
| 7,191,523 | B2 | 3/2007 | Miyazaki et al. | |
| 8,074,535 | B2 | 12/2011 | Martell | |
| 8,381,406 | B2 * | 2/2013 | Miyazaki | B26B 21/4012 30/51 |
| 8,595,938 | B2 * | 12/2013 | Bodet | B26B 21/52 30/47 |
| 8,671,576 | B1 * | 3/2014 | Hotella | B26B 21/4012 30/526 |
| 8,726,520 | B1 | 5/2014 | Abraham | |
| 10,906,196 | B2 * | 2/2021 | Hahn | B26B 21/4012 |
| 11,235,483 | B2 * | 2/2022 | Hahn | B26B 21/4012 |
| D970,814 | S * | 11/2022 | Hahn | B26B 21/16 D28/46 |
| 2002/0157259 | A1 | 10/2002 | Coffin | |
| 2004/0177511 | A1 | 9/2004 | Miyazaki et al. | |
| 2009/0000426 | A1 | 1/2009 | Andersen et al. | |
| 2009/0056137 | A1 | 3/2009 | Royle | |
| 2010/0139103 | A1 | 6/2010 | Miyazaki | |
| 2010/0223792 | A1 | 9/2010 | Martell | |
| 2013/0237134 | A1 | 9/2013 | Worthington | |
| 2014/0190014 | A1 | 7/2014 | Hahn | |
| 2015/0360375 | A1 | 12/2015 | Wertz | |
| 2022/0134587 | A1 * | 5/2022 | Hahn | B26B 21/4012 30/32 |

* cited by examiner

TRIMMER RAZOR WITH CAM TRACK

CROSS-REFERENCE TO RELATED APPLICATIONS

This application claims the benefit of U.S. Provisional Patent Application No. 62/994,107, filed Mar. 24, 2020, the disclosure of which is incorporated by reference in its entirety.

BACKGROUND OF THE INVENTION

Field of the Invention

This disclosure relates generally to razors and, more particularly, to a trimmer razor with replaceable blades.

Description of Related Art

Razors have become ubiquitous and are used by both men and women for their personal shaving needs. Straight-blade razors, which are made of high carbon or stainless steel, exemplify the early modern popular style of shaving implements. These razors can be used for many shaving sessions over a longer period of time, but must be maintained by regular sharpening or stropping. The process of sharpening, or honing, the blade uses an abrasive material that removes material from the blade's edge. Stropping, which must be done with each use of a straight-blade razor, straightens and re-aligns the blade, which tends to bend and pit under use preventing a close shave if not straightened.

Double-edged safety razors replaced the straight edge in popularity in the early part of the twentieth century. The disposal of blades after limited use was made popular and economical by the arrival of blades made of low-cost, thin steel, thereby eliminating the need for stropping or honing. The safety feature of these razors, protecting the user from all but the very edge of the blade, appealed to the user. The orientation of the handle and the blade required the user to develop the proper technique to achieve an optimal shave. The next evolution combined the safety of small, thin blades exposed only at the edge with the proper angle-of-attack and a pivoting head to adjust to the contours of the body. The disposable razor embodied the ease and simplicity of shaving, sacrificing longevity of product by providing disposable blades with limited life. This incarnation of men's and women's personal shavers remains the most popular and widely used, contributing a sizeable negative global economic impact.

While the convenience and ease of use of current disposable razor technology is attractive to users, alternative razors using double-edged blades have continued to evolve. Many of the current safety razors use one double-edged blade and clamp the blade to the head of the safety razor to hold it rigidly in place. Typically, one blade edge is exposed on each side of the razor head. Many of these safety razors, however, do not include a pivoting head, thereby requiring a user to hold the razor and blade at a specific angle to his/her face to receive a proper shave. This can lead to a tedious process that does not always provide the close shave that one desires.

Trimmer razors have recently been incorporated into cartridge razors to aid in reaching hard-to-reach areas of the body, such as under the nose, where larger multiple-blade cartridges cannot reach due to their larger size and/or additional features included on the cartridge such as lubricating strips. These trimmer razors have minimal material surrounding the blade that could block the blade from being positioned in a correct position to shave the user's hair. In addition to providing increased utility, trimmer razors also assist in producing precise hair lines, such as sideburns and beards, due to an increase in visualization for the user of where the blade will actually land on the skin surface. In multiple-blade cartridges, the surrounding cartridge material can be bulky and prohibit an accurate sense of where the blades will actually cut the hair, making a precise shave difficult to achieve.

Current trimmer razors are currently incorporated into expensive disposable cartridge razors. During a typical shave, the trimmer razor only cuts a fraction of the hair that the remaining blades cut, since the remaining blades cut the hair on the majority of the area to be shaved. These main blades wear out much more quickly than the trimmer razor blades. Since the main blades are connected to the trimmer blade in the cartridge, however, the trimmer blades are often disposed of at the same time as when the main blades become dull and need replaced with new blades. Disposal of the trimmer razor not only increases waste, but also increases the cost of the entire cartridge unnecessarily.

SUMMARY OF THE INVENTION

In accordance with one aspect of the disclosure, a trimmer razor includes a handle, a head operatively connected to the handle, the head including a base member defining a cam track, a seat extending from the base member, and a cover connected to the seat; and an extension arrangement connecting the cover to the handle so that, upon rotation of the handle, the cover is movable between an open position in which the cover is spaced from the seat and a closed position in which the cover is clamped to the seat, wherein the extension arrangement includes a rod connected to the cover and a cam pin extending from the rod, and wherein the cam pin is configured to follow the cam track so that, when the cover moves from the closed position to the open position, the cover rotates relative to the seat. The handle may define a hollow bore configured to receive a connecting member therethrough. The connecting member may be configured to connect the handle with at least a portion of the head.

In accordance with another aspect or embodiment, the connecting member may be threaded at at least one end, and the hollow bore may be configured to receive the at least one threaded end of the connecting member therein. The head may include a threaded portion complimentary to the threaded at least one end of the connecting member. A fastener may extend through the cover and into the connecting member. The end of the head may include a first opening configured to permit the passage of the connecting member and fastener therethrough and a second opening configured to permit the passage of the rod therethrough. The second opening may be at least partially curved. A bottom portion of the handle may define a hollow bore configured to receive a first end of the rod therein. The cover may include a receiving portion configured to receive a second end of the rod therein.

In accordance with another aspect or embodiment, a top portion of the handle includes the head, and wherein the rod and at least a portion of the receiving portion extend through a bore defined by the top portion of the handle. A shield may be configured to engage the head and cover at least a portion of the cam track. The cam track may include a first portion, extending linearly along the head, and a second portion, curing about the head. The cover may rotate 90 degrees relative to the seat.

In accordance with another aspect or embodiment of the present disclosure, a trimmer razor may include a handle defining a hollow bore and a cam track therein; a head operatively connected to the handle, the head including a base member, a seat extending from the base member, and a cover connected to the seat; and an extension arrangement connecting the cover to the handle so that, upon rotation of the handle, the cover is movable between an open position, in which the cover is spaced from the seat, and a closed position, in which the cover is clamped to the seat. The extension arrangement may include a rod connected to the cover and extending into a hollow bore, the rod may include a cam pin extending from the rod. The cam pin may be configured to follow the cam track so that, when the cover moves from the closed position to the open position, the cover rotates relative to the seat.

In accordance with yet another aspect or embodiment, at least one end of the rod may be threaded, and an end of the hollow bore opposing the head may define a thread complimentary to the at least one threaded end of the rod for receiving the threaded end of the rod therein. The head may further include an attachment portion configured to connect the cover to the rod. The cover may include an alignment member configured to fit about the connecting rod and rotate with the cam pin upon movement of the cover form the closed position to the open position. The handle may further include a track member configured to fit within the hollow bore, the track member defining the cam track. The track member may include at least one alignment flange extending in the direction of the head. The alignment member may include an opening configured to receive the at least one alignment flange therein when in the closed position.

Further aspects of the disclosure will now be described in the following numbered clauses.

Clause 1: A trimmer razor, comprising a handle; a head operatively connected to the handle, the head comprising a base member defining a cam track, a seat extending from the base member, and a cover connected to the seat; and an extension arrangement connecting the cover to the handle so that, upon rotation of the handle, the cover is movable between an open position in which the cover is spaced from the seat and a closed position in which the cover is clamped to the seat, wherein the extension arrangement includes a rod connected to the cover and a cam pin extending from the rod, and wherein the cam pin is configured to follow the cam track so that, when the cover moves from the closed position to the open position, the cover rotates relative to the seat.

Clause 2: The trimmer razor of clause 1, wherein the handle defines a hollow bore configured to receive a connecting member therethrough, the connecting member configured to connect the handle with at least a portion of the head.

Clause 3: The trimmer razor of clause 1 or 2, wherein the connecting member is threaded at at least one end, and wherein the hollow bore is configured to receive the at least one threaded end of the connecting member therein Clause 4: The trimmer razor of any of clauses 1-3, wherein the head comprises a threaded portion complimentary to the threaded at least one end of the connecting member.

Clause 5: The trimmer razor of any of clauses 1-4, further comprising a fastener extending through the cover and into the connecting member.

Clause 6: The trimmer razor of any of clauses 1-5, wherein the end of the head comprises a first opening configured to permit the passage of the connecting member and fastener therethrough and a second opening configured to permit the passage of the rod therethrough.

Clause 7: The trimmer razor of any of clauses 1-6, wherein the second opening is at least partially curved.

Clause 8: The trimmer razor of any of clauses 1-7, wherein a bottom portion of the handle defines a hollow bore configured to receive a first end of the rod therein.

Clause 9: The trimmer razor of any of clauses 1-8, wherein the cover comprises a receiving portion configured to receive a second end of the rod therein.

Clause 10: The trimmer razor of any of clauses 1-9, wherein a top portion of the handle includes the head, and wherein the rod and at least a portion of the receiving portion extend through a bore defined by the top portion of the handle.

Clause 11: The trimmer razor of any of clauses 1-10, further comprising a shield configured to engage the head and cover at least a portion of the cam track.

Clause 12: The trimmer razor of any of clauses 1-11, wherein the cam track comprises a first portion, extending linearly along the head, and a second portion, curving about the head.

Clause 13: The trimmer razor of any of clauses 1-12, wherein the cover rotates 90 degrees relative to the seat.

Clause 14: A trimmer razor comprising: a handle defining a hollow bore and a cam track therein; a head operatively connected to the handle, the head comprising a base member, a seat extending from the base member, and a cover connected to the seat; and an extension arrangement connecting the cover to the handle so that, upon rotation of the handle, the cover is movable between an open position, in which the cover is spaced from the seat, and a closed position, in which the cover is clamped to the seat, wherein the extension arrangement comprises a rod connected to the cover and extending into a hollow bore, the rod comprising a cam pin extending from the rod, and wherein the cam pin is configured to follow the cam track so that, when the cover moves from the closed position to the open position, the cover rotates relative to the seat.

Clause 15: The trimmer razor of clause 14, wherein at least one end of the rod is threaded, and wherein an end of the hollow bore opposing the head defines a thread complimentary to the at least one threaded end of the rod for receiving the threaded end of the rod therein.

Clause 16: The trimmer razor of clause 14 or 15, wherein the head further comprises an attachment portion configured to connect the cover to the rod.

Clause 17: The trimmer razor of any of clauses 14-16, wherein the cover comprises an alignment member configured to fit about the connecting rod and rotate with the cam pin upon movement of the cover form the closed position to the open position.

Clause 18: The trimmer razor of any of clauses 14-17, wherein the handle further comprises a track member configured to fit within the hollow bore, the track member defining the cam track.

Clause 19: The trimmer razor of any of clauses 14-18, wherein the track member comprises at least one alignment flange extending in the direction of the head.

Clause 20: The trimmer razor of any of clauses 14-19, wherein the alignment member comprises an opening configured to receive the at least one alignment flange therein when in the closed position.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced aspect as it is oriented in the accompanying drawings, figures, or otherwise described in the following detailed description. However, it is to be understood that the aspects described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, a razor and, in particular, a trimmer razor with replaceable blades. Certain preferred and non-limiting aspects of the components of the trimmer razor are illustrated in FIGS. 1-35C.

With reference to FIGS. 1-7, one aspect of a trimmer razor 2 (hereinafter referred to as "razor 2") is described. The razor 2 may include a handle 4 and a head 6. In one aspect, the head 6 is held stationary relative to the handle 4. In another aspect, the head 6 may be pivotable or rotatable relative to or about the handle 4. The head 6 may have a substantially rectangular shape. In one aspect, the handle 4 may have a substantially cylindrical cross-sectional shape. However, it is also contemplated that alternative shapes may be used, such as triangular, oval, square, or trapezoidal. The handle 4 may include different types of surfaces, including small protrusions, bumps, waves, or indentations 8, to provide a comforting ergonomic feel when held by an individual.

Figure 1:
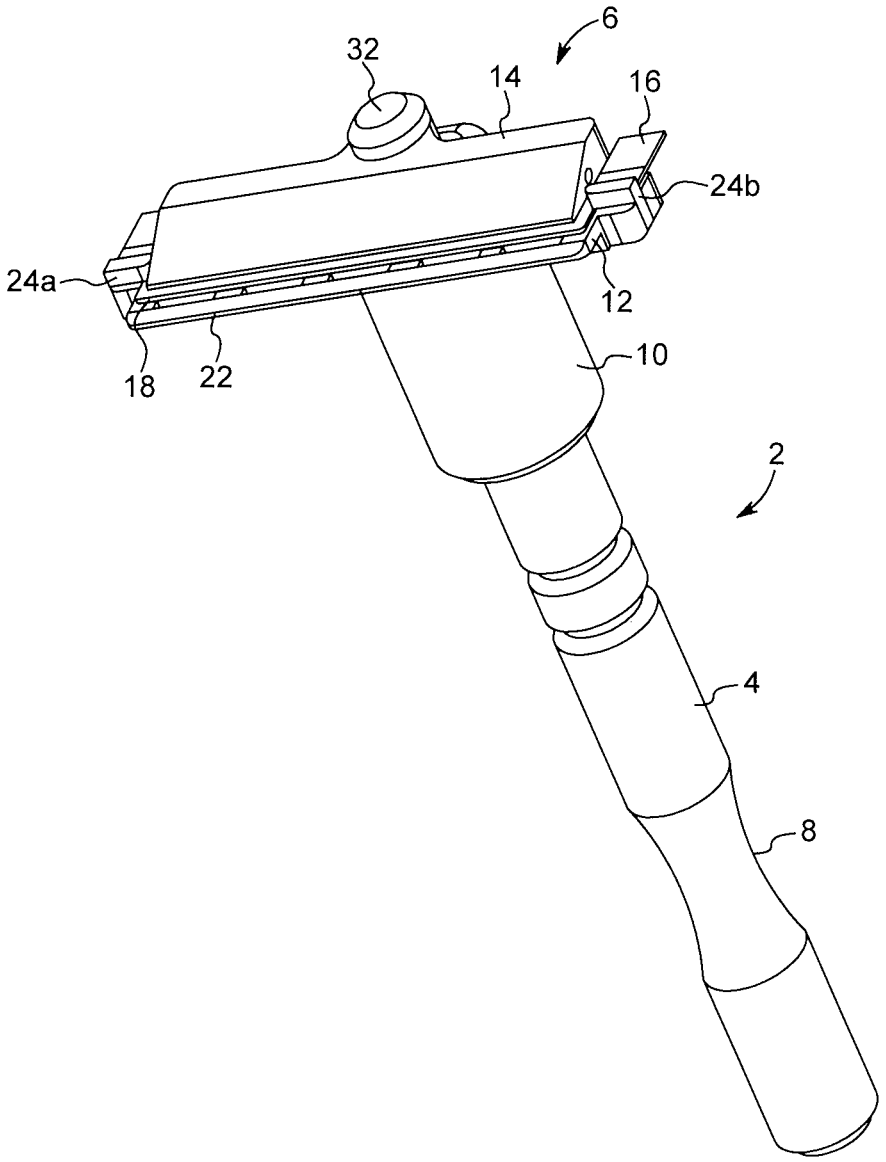
FIG. 1 is a perspective view of a razor in accordance with one aspect of the present disclosure.
Figure 2:
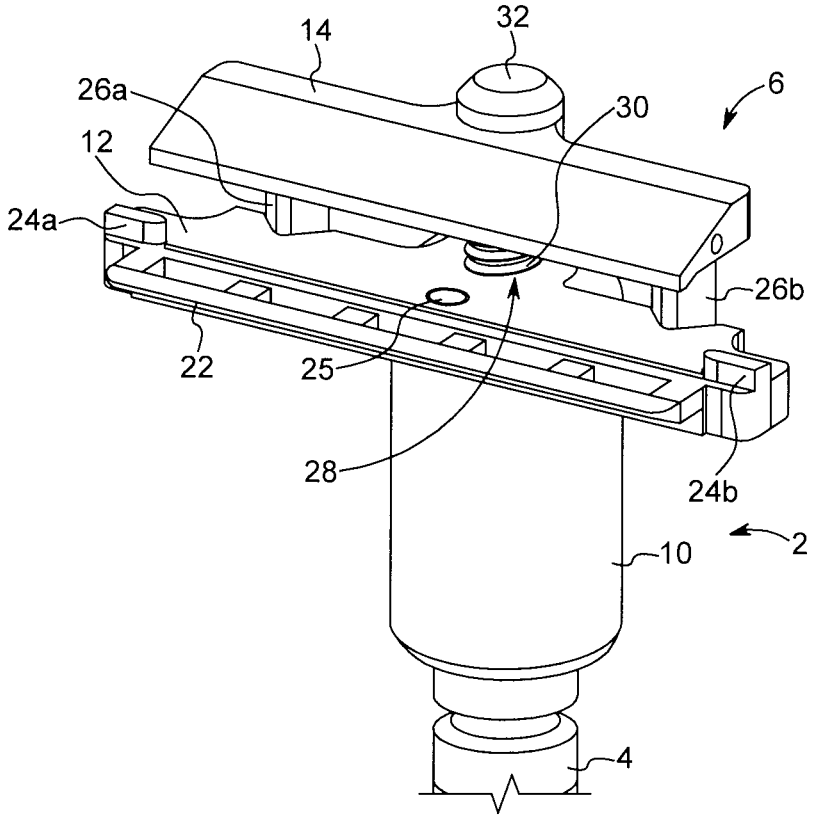
FIG. 2 is a perspective view of a head of the razor of FIG. 1 in an open position without a razor blade.
Figure 3:
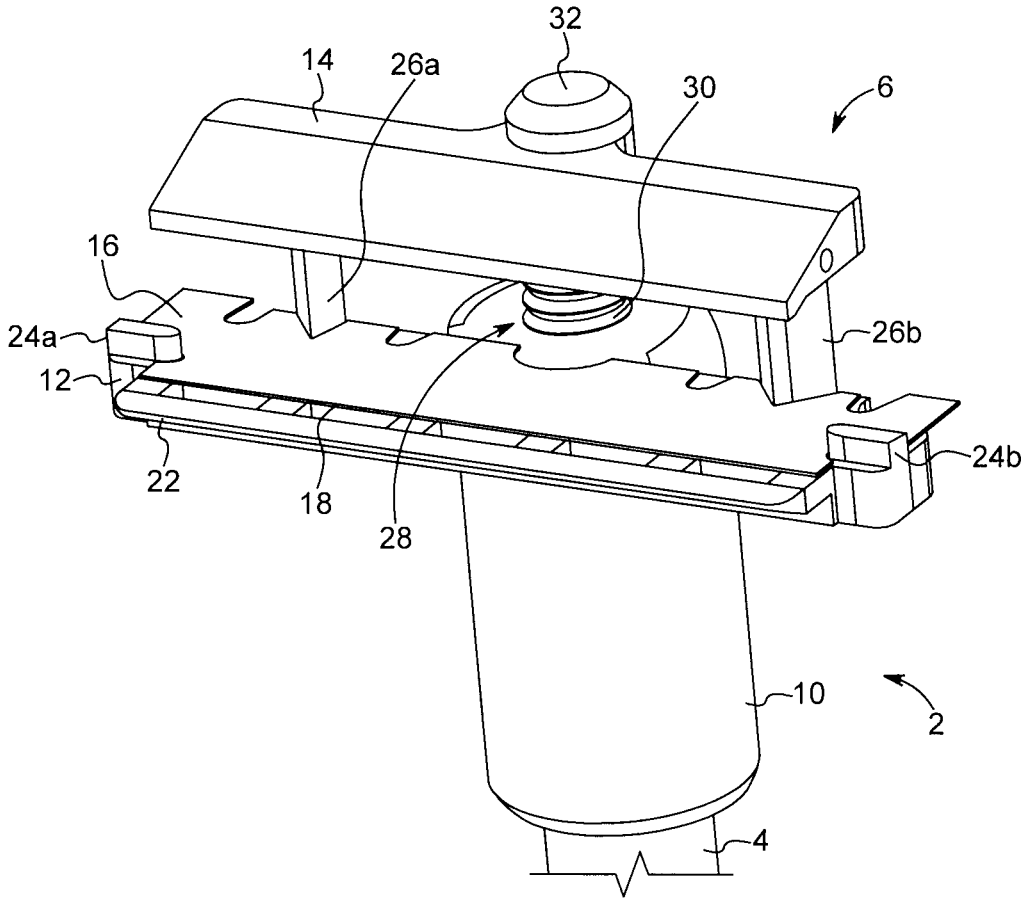
FIG. 3 is a perspective view of the head of the razor of FIG. 1 in an open position with a razor blade inserted therein.
Figure 4:
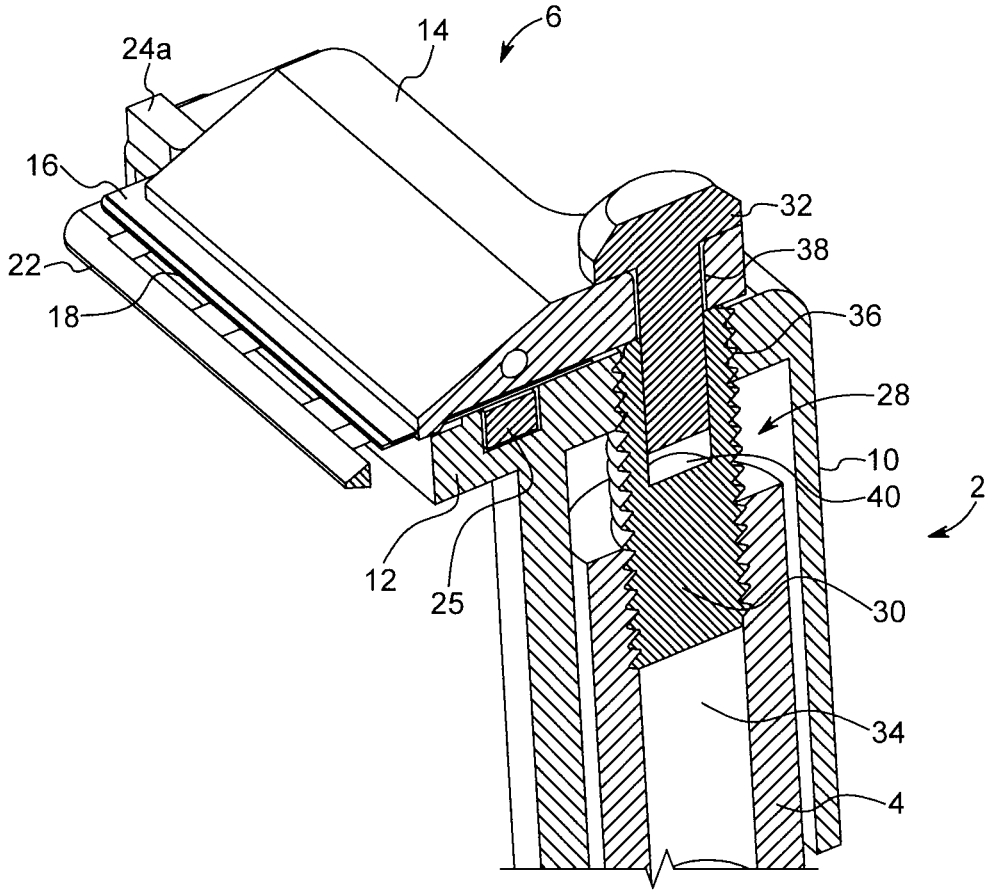
FIG. 4 is a cross-sectional perspective view of the head of the razor of FIG. 1 in a closed position.
Figure 5:
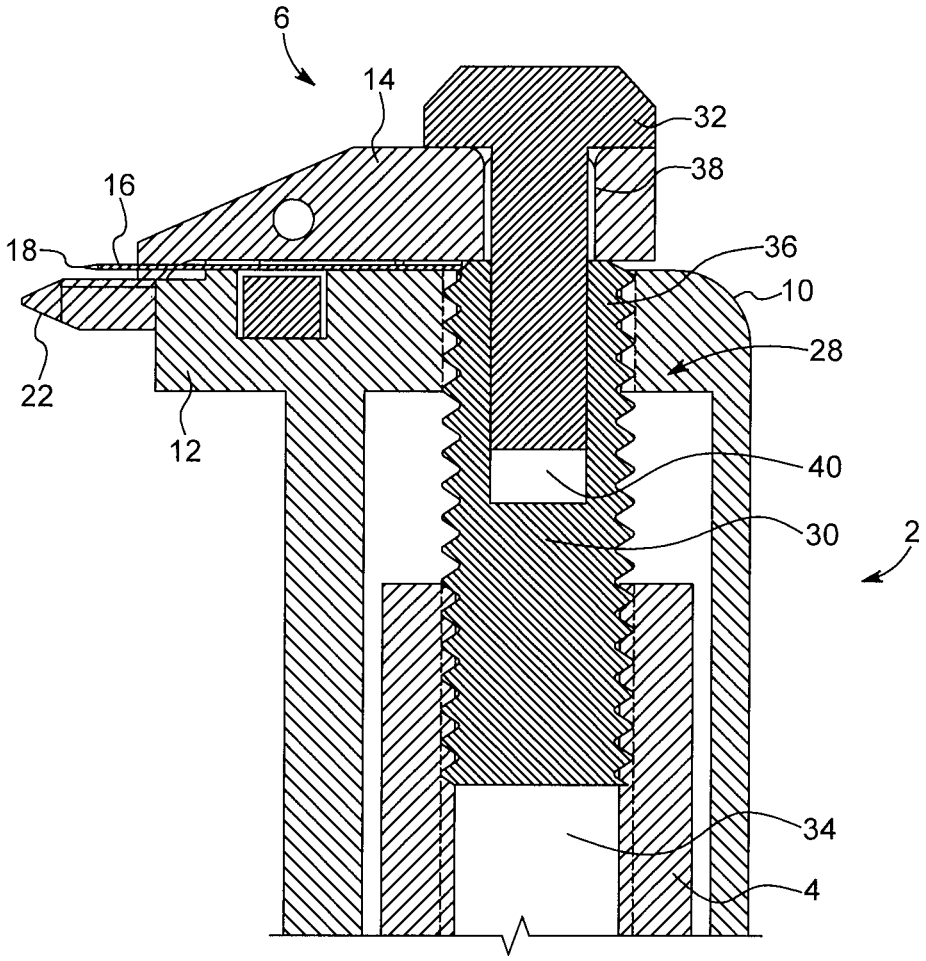
FIG. 5 is a cross-sectional side view of the head of the razor of FIG. 1 in the closed position.
Figure 6:
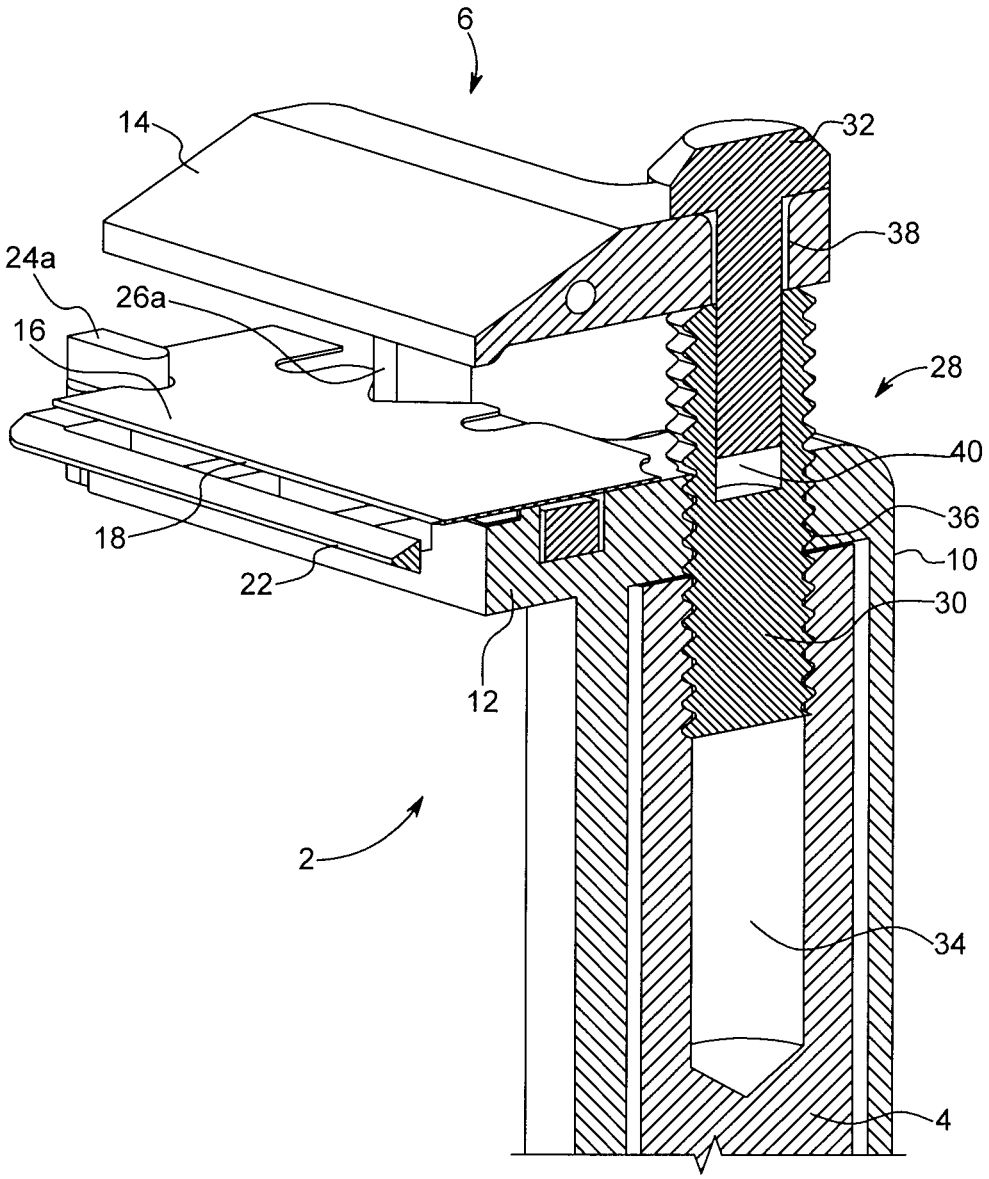
FIG. 6 is a cross-sectional perspective view of the head of the razor of FIG. 1 in the open position.
Figure 7:
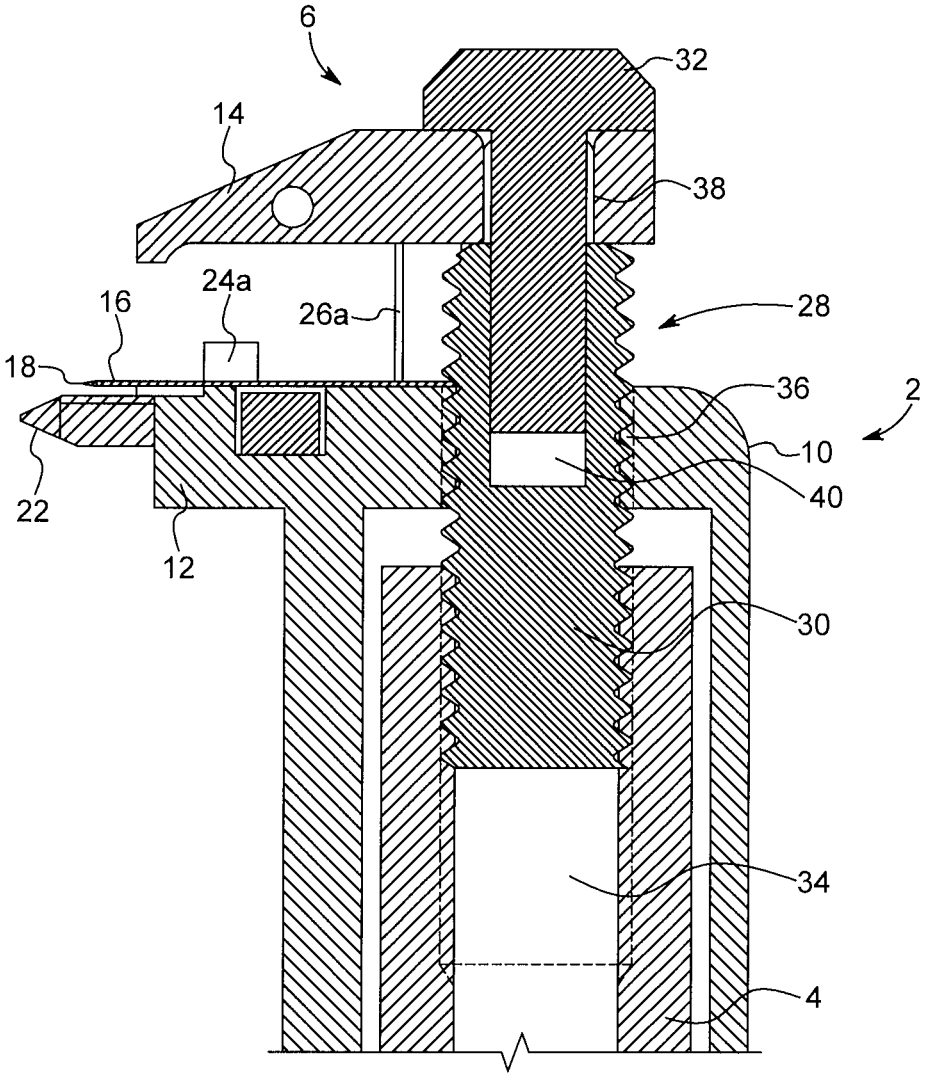
FIG. 7 is a cross-sectional side view of the head of the razor of FIG. 1 in the open position.

With reference to FIG. 2, in one aspect, the head 6 includes a base member 10 operatively connected to the handle 4, as described below, a seat 12 formed on the base member 10, and a cover 14 operatively connected to the base member 10 and the handle 4. The base member 10 is substantially cylindrical and is dimensioned to fit around an outer surface of one end of the handle 4. In one aspect, the inner diameter of the base member 10 is slightly larger than the outer diameter of the end of the handle 4 so that the base member 10 fits around the outer surface of the end of the handle 4. The seat 12 is formed on the base member 10 and extends from an upper surface of the base member 10. The seat 12 is configured to receive and hold a razor blade 16 within the razor 2. The seat 12 includes a guard member 22 that extends along the length of a front end of the seat 12. In one aspect, at least two protrusions 24*a*, 24*b* extend from an upper surface of the seat 12. The protrusions 24*a*, 24*b* assist in positioning and retaining the razor blade 16 in a proper orientation on the seat 12. The protrusions 24*a*, 24*b* are positioned on the seat 12 so that the razor blade 16 rests against the protrusions 24*a*, 24*b* and extends from the head 6 to allow shaving with the razor blade 16. The protrusions 24*a*, 24*b* also assist in retaining and holding the razor blade 16 within the head 6 so that the razor blade 16 does not slide out of the head 6. The protrusions 24*a*, 24*b* may constrain the razor blade 16 in two degrees of freedom on the seat 12. As shown in FIG. 2, a magnet 25 may also be provided in an aperture defined in the seat 12 to assist in securing the razor blade 16 within the head 6. The magnet 25 also assists in holding the razor blade 16 to the seat 12 while the user aligns the razor blade 16 with the protrusions 24*a*, 24*b*. Although the use of only one magnet 25 is shown with the razor 2, it is also contemplated that additional magnets may be provided in the seat 12 and/or the cover 14 to assist in holding the razor blade 16 within the head 6.

Figure 14:
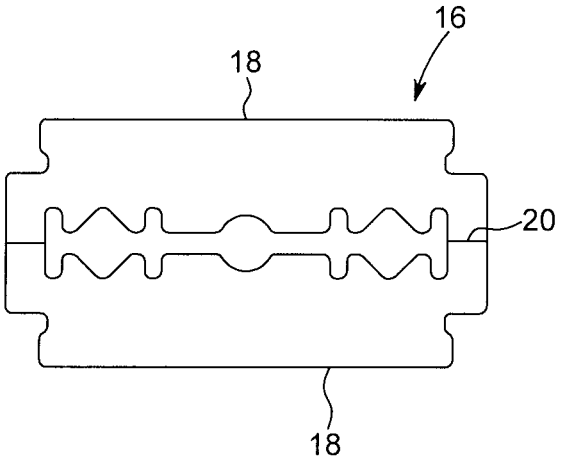
FIG. 14 is a top view of a razor blade used with the razor of the present application.

In one aspect, the blade 16 is formed from a double-edged razor blade. An example of such a double-edged razor blade 16 is shown in FIG. 14. As used herein, the "shaving edge" or like terms of the razors of the present invention refers to a leading surface or portion of the head 6 such that, when in use, the shaving edge is followed by the exposed razor edges 18 that contact a user's skin. Typically, double-edged razor blades include two opposing razor edges 18 connected by a weak or thin body member 20 that defines a perimeter profile and a profiled cut-out. The razor blade 16 is shown as a conventional double-edged blade, but this is not meant to be limiting. It should be appreciated that the razor edge 18 of the razor blade 16 includes an outermost edge for contacting skin with the razor edge 18 tapering from the razor body 20. Other embodiments of razor blades (single-edged and double-edged) with various perimeter profiles and/or central cut-out profiles are encompassed within the present invention. Presently, many manufacturers make these types of double-edged razor blades that use a standardized shape to fit in traditional safety razors. In one aspect, the blade 16 of the razor 2 may be this type of double-edged blade. By "weak and thin", it is meant that the blades are typically designed so that an individual can break a double-edged razor blade in half by hand, splitting along a centerline of the profile cut-out. By breaking the double-edged razor blades in half, two "half blades" or two halves of the double-edged razor blade are provided. Each half may include one razor edge 18. It is also to be understood that the "half blades" may be provided in this initial form, without the need for breaking a double-edged razor blade in half. While it is contemplated that any type of double-edged razor blade may be used with the razor 2, it is also contemplated that specific "half blades" may be designed and configured to custom fit in the seat 12 and cover 14 of the head 6.

With reference to FIGS. 3-7, the cover 14 of the head 6 is slidable between an open position and a closed position. In the open position, the cover 14 is positioned for removal and/or insertion of a razor blade 16 within the head 6. In the closed position, the cover 14 is positioned to hold the razor blade 16 within the head 6 to permit a user to shave with the razor 2. The cover 14 extends along the head 6 to substantially cover the razor blade 16 when the razor blade 16 is held within the head 6. In one aspect, the cover 14 includes two extension members 26*a*, 26*b* that extend from a bottom surface of the cover 14 and are received within the seat 12. The extension members 26*a*, 26*b* are slidably positioned within the seat 12 to guide the cover 14 when moving relative to the seat 12. Furthermore, the extension members 26*a*, 26*b* prevent the cover 14 from rotating relative to the seat 12 when the cover 14 is moved between the open and closed positions.

With reference to FIGS. 4-7, an extension arrangement 28 is provided between the cover 14, the base member 10, and the handle 4 to assist in moving the cover 14 relative to the seat 12. The extension arrangement 28 includes a screw member 30 and a fastener 32. One end of the screw member 30 is threaded into and held within the handle 4. The top end of the handle 4 defines a cavity 34 that includes a threaded inner surface to receive one end of the screw member 30. A second end of the screw member 30 is threaded into a threaded aperture 36 defined in the base member 10. The extension arrangement 28 is operatively connected to the cover 14 using the fastener 32. The fastener 32 is inserted through an aperture 38 defined in the cover 14 and received in a cavity 40 defined in the screw member 30. The cavity 40 is defined by an upper end of the screw member 30. The fastener 32 is held in the cavity 40 of the screw member 30 via a friction fit. It is also contemplated that the fastener 32 may be welded or molded within the cavity 40 of the screw member 30. When assembled, the fastener 32 is positioned within the extension arrangement 28 to clamp the cover 14 between the fastener 32 and the base member 10.

With continued reference to FIGS. 4-7, operation of the extension arrangement 28 is described. As the handle 4 is rotated, the screw member 30 moves through the aperture 36 to raise or lower the cover 14 relative to the seat 12. In one aspect, when the handle 4 is rotated in a counterclockwise direction, the screw member 30 is moved upwardly through the aperture 36. The screw member 30 moves upwardly through the aperture 36 until the upper end of the handle 4 contacts the base member 10. Since the cover 14 is clamped between the fastener 32 and the screw member 30, as the screw member 30 moves upwardly through the aperture 36, the cover 14 is also raised upwardly relative to the seat 12. By raising the cover 14 relative to the seat 12, the head 6 is moved to the open position to allow a user to remove and/or insert a razor blade 16 on the seat 12 of the head 6.

In one aspect, as the handle 4 is rotated in a clockwise direction, the screw member 30 is moved downwardly through the aperture 36. The screw member 30 moves downwardly through the aperture 36 until the bottom surface of the cover 14 contacts the base member 10. Since the cover 14 is clamped between the fastener 32 and the screw member 30, as the screw member 30 moves downwardly through the aperture 36, the cover 14 is also moved downwardly relative to the seat 12. By lowering the cover 14 relative to the seat 12, the head 6 is moved to the closed position to clamp the razor blade 16 against the seat 12 within the head 6.

The razor 2 can serve as a trimmer razor that can be used separately from conventional cartridge razors and uses low-cost thin metal blades, such as the double-edged blade. The razor 2 includes a low profile to provide better access to hard-to-reach areas as well as to provide better visualization of where the razor blades 16 will shave on the user's skin surface to produce fine and more accurate shaving lines. Since the razor 2 is decoupled from any other blades used to shave a user's skin surface, the razor blade 16 installed in the razor 2 lasts much longer than traditional trimmer blades incorporated within multi-blade razor cartridges. This longevity of the trimmer razor 2, coupled with the type of blades that are used in the razor 2, provide a low ongoing cost to the user to use such a trimmer razor 2.

Figure 8:
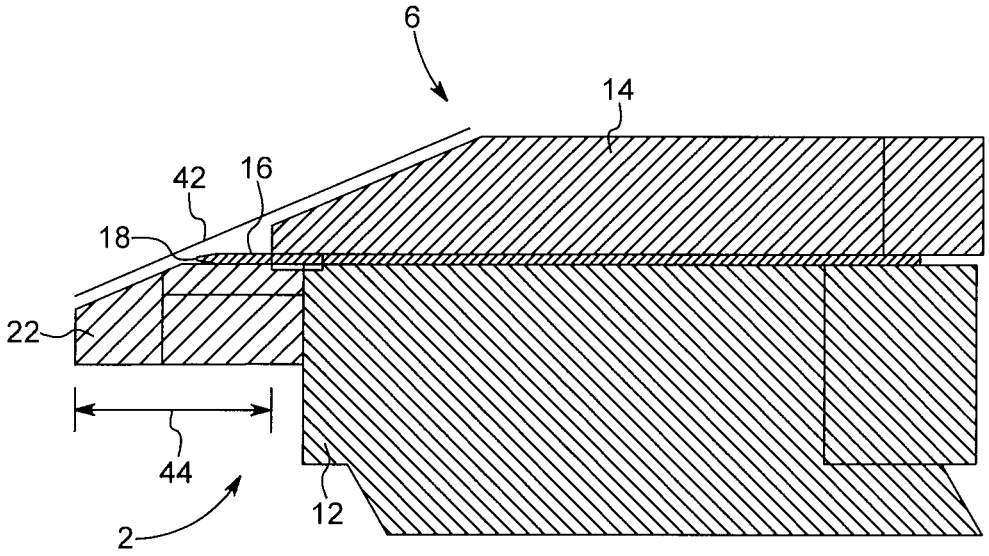
FIG. 8 is a side view of a head of a razor according to one aspect of the present disclosure.

As shown in FIG. 8, the razor 2 accepts the razor blade 16 and places the blade 16 in a precise and repeatable position that allows the user to shave comfortably with the blade 16 in an optimal position for hair removal from the user's skin surface. The outer surface of the cover 14 and the seat 12 create a shave plane 42 that is configured to assist the user in positioning the razor 2 in the correct orientation on the user's skin surface. By pressing the shave plane 42 against the user's skin surface, the blade 16 is oriented in a shaving position so that the blade 16 shaves the user's hair. Conventional double-edged razors have a curved shave plane surface, necessitating the need to hold the razor at a precise angle while shaving. Some users find this additional level of control to be difficult and time consuming. The razor 2 of the present disclosure provides a substantially flat or planar shave plane 42 surface to which the user's skin conforms, making the task of holding the razor 2 at the correct angle less important. This makes the use of the razor 2 of the present disclosure easier than the use of conventional double-edged razors and reduces the chances of nicks, cuts, and skin irritation. In one aspect, the seat 12 also provides a shaving gap 44 between the leading edge of the cover 14 and the leading edge of the seat 12. The leading edges of the seat 12 and the cover 14 are considered to be the edges of the seat 12 and cover 14 that contact the user's skin surface when using the razor 2. The size of the shaving gap 44 determines the amount of the user's skin surface that is exposed to the razor blade 16 prior to the razor edge 18 of the razor blade 16 contacting the user's skin surface.

Figure 9:
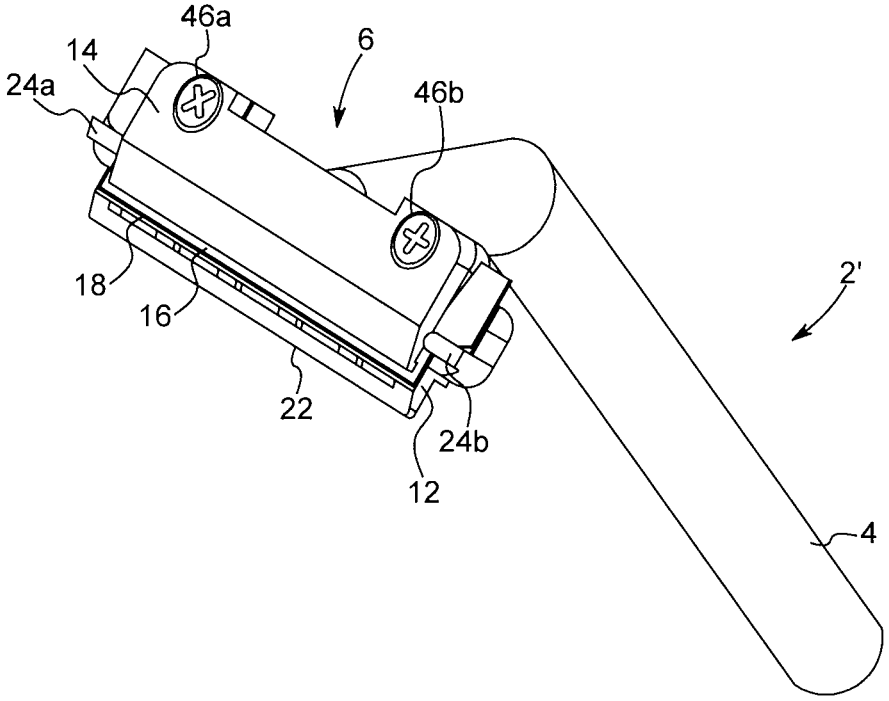
FIG. 9 is a perspective view of a razor according to another aspect of the present disclosure.
Figure 10:
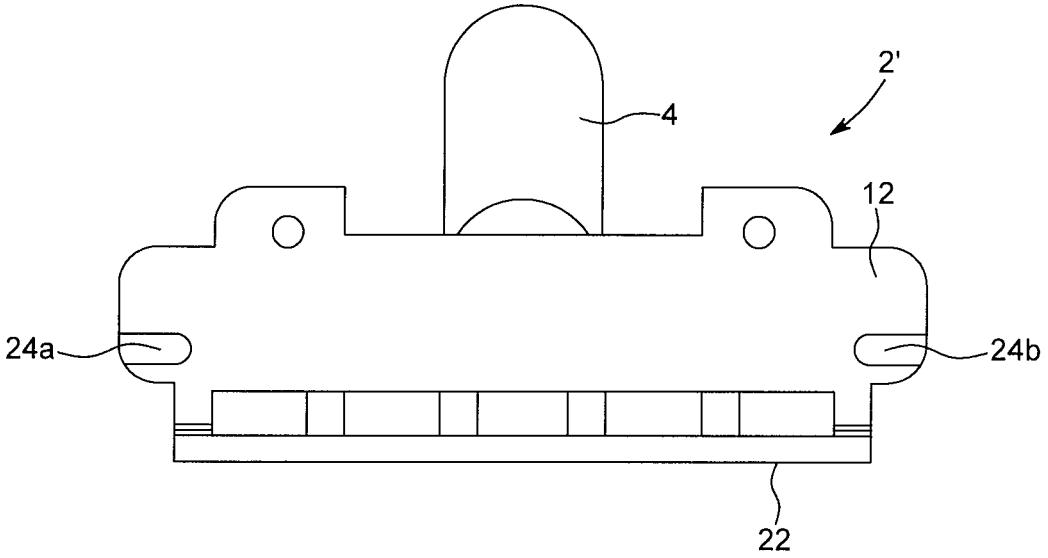
FIG. 10 is a top view of a head of the razor of FIG. 9 without a razor blade held thereon.
Figure 11:
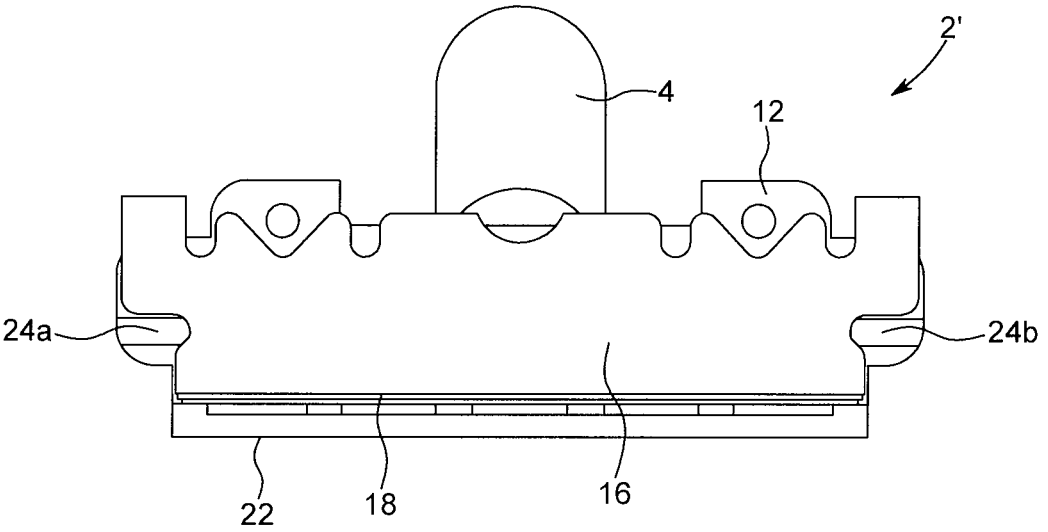
FIG. 11 is a top view of the head of the razor of FIG. 9 with a razor blade held thereon.
Figure 12:
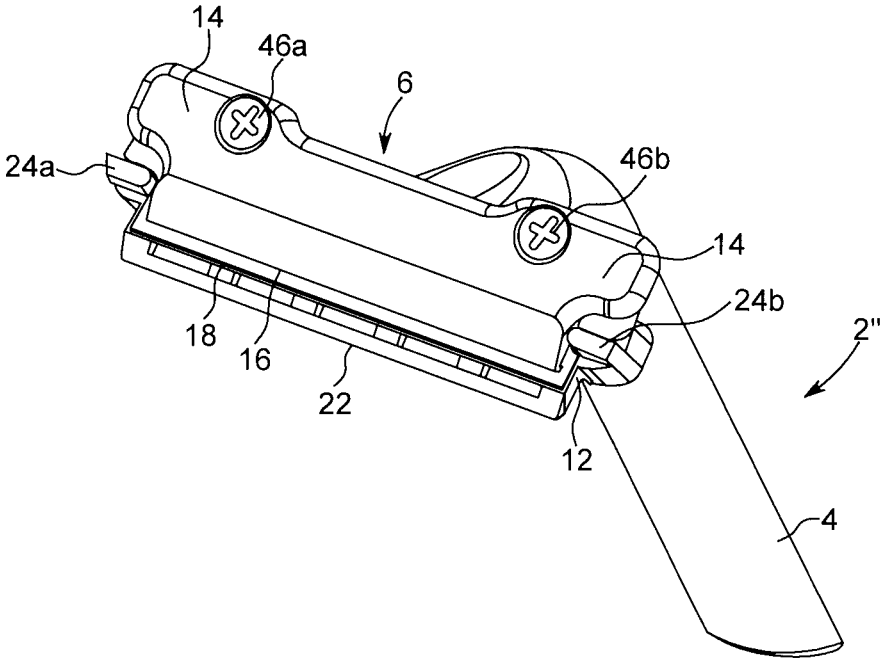
FIG. 12 is a perspective view of a razor according to another aspect of the present disclosure.

With reference to FIG. 9-11, in another aspect of the disclosure, a razor 2' includes a different clamping mechanism to hold the razor blade 16 within the head 6. This aspect of the razor 2' does not utilize the extension arrangement 28 to move the cover 14 relative to the seat 12. Instead, two fasteners 46*a*, 46*b* extend through the cover 14 and into the seat 12. In one aspect, the fasteners 46*a*, 46*b* are screws that can be rotated to tighten and clamp the cover 14 to the seat 12. The fasteners 46*a*, 46*b* can be unscrewed to move the cover 14 to an open position to permit the user to remove and/or insert the razor blade 16 into the head 6. The fasteners 46*a*, 46*b* can also be screwed and tightened to clamp the razor blade 16 between the seat 12 and the cover 14. Although screws are used as the fasteners 46*a*, 46*b* in FIG. 9, it is also contemplated that other types of fasteners can be used to tighten and loosen the cover 14 to and from the seat 12. As shown in FIGS. 10 and 11, the razor 2' also includes similar protrusions 24*a*, 24*b* to constrain the razor blade 16 in two degrees of freedom. As shown in FIG. 12, in another aspect, the ends of the cover 14 are extended over the ends of the razor blade 16 to prevent the user from cutting him/herself on the sides of the razor blade 16. In this aspect, the length of the cover 14 is substantially equal to the length of the razor blade 16 and the length of the seat 12.

Figure 13:
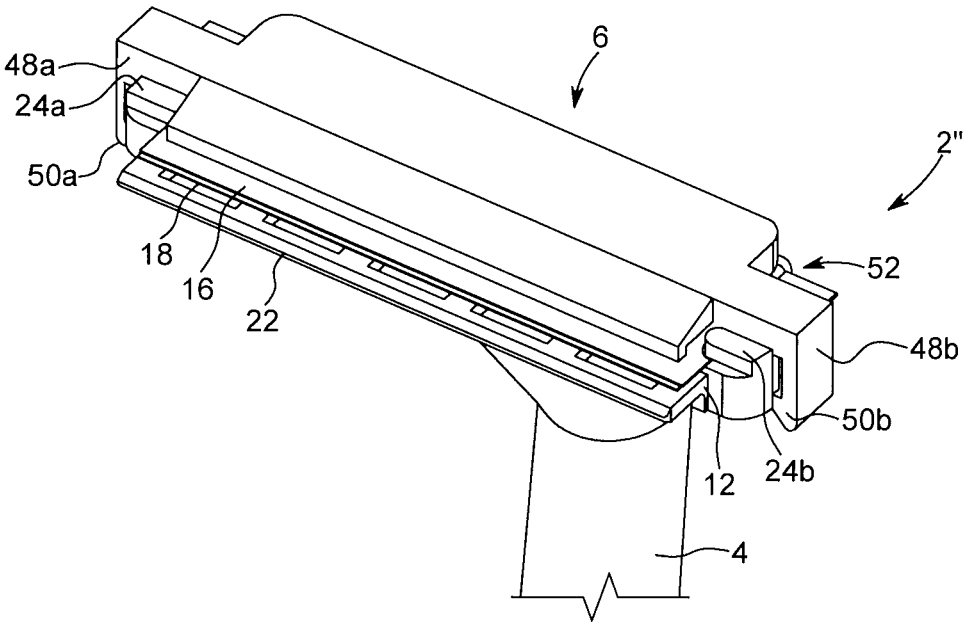
FIG. 13 is a perspective view of a head of a razor according to another aspect of the present disclosure.

With reference to FIG. 13, another aspect of a razor 2" is described. In this aspect, instead of using the extension arrangement 28 or the fasteners 46*a*, 46*b* to clamp the cover 14 to the seat 12, a pair of locking tabs 48*a*, 48*b* extend from the ends of the cover 14 to hold the cover 14 to the seat 12. The locking tabs 48*a*, 48*b* extend downwardly from a top surface of the cover 14 toward the seat 12. One end of each locking tab 48*a*, 48*b* includes a locking hook 50*a*, 50*b* that is used to latch the locking tabs 48*a*, 48*b* on the seat 12. In one aspect, the locking hooks 50*a*, 50*b* latch onto a bottom surface of the seat 12. In another aspect, the locking hooks 50*a*, 50*b* latch onto a protrusion that extends from the seat 12. In one aspect, the locking tabs 48*a*, 48*b* are at least partially elastic to permit a user to bend the locking tabs 48*a*, 48*b* outwardly away from the seat 12 to move the cover 14 onto the seat 12. After the cover 14 has been clamped on the seat 12, the locking tabs 48*a*, 48*b* are released to snap back into place and lock the cover 14 in the clamping position against the seat 12 to hold the razor blade 16 therebetween. It is also contemplated that the user may press down on the upper surface of the cover 14, thereby forcing the locking tabs 48*a*, 48*b* to move outwardly until the locking hooks 50*a*, 50*b* latch onto the seat 12. As shown in FIG. 13, in this aspect, the cover 14 is connected to the seat 12 via a hinge 52. In this aspect, the cover 14 is rotatable relative to the seat 12 to permit access to the seat 12 for removing and/or replacing the razor blade 16 therein. It is also contemplated that the cover 14 is only held on the seat 12 using the locking tabs 48*a*, 48*b*.

With reference to FIGS. 15-22, one aspect of a trimmer razor 102 (hereinafter referred to as "razor 102") is described. The razor 102 may include a handle 104 and a head 106. In one aspect, the head 106 is held stationary relative to the handle 104. In another aspect, the head 106 may be pivotable or rotatable relative to or about the handle 104. The head 106 may have a substantially rectangular shape. In one aspect, the handle 104 may have a substantially cylindrical cross-sectional shape. However, it is also contemplated that alternative shapes may be used, such as triangular, oval, square, or trapezoidal. The handle 104 may include different types of surfaces, including small protrusions, bumps, waves, or indentations 108, to provide a comforting ergonomic feel when held by an individual.

Figure 15:
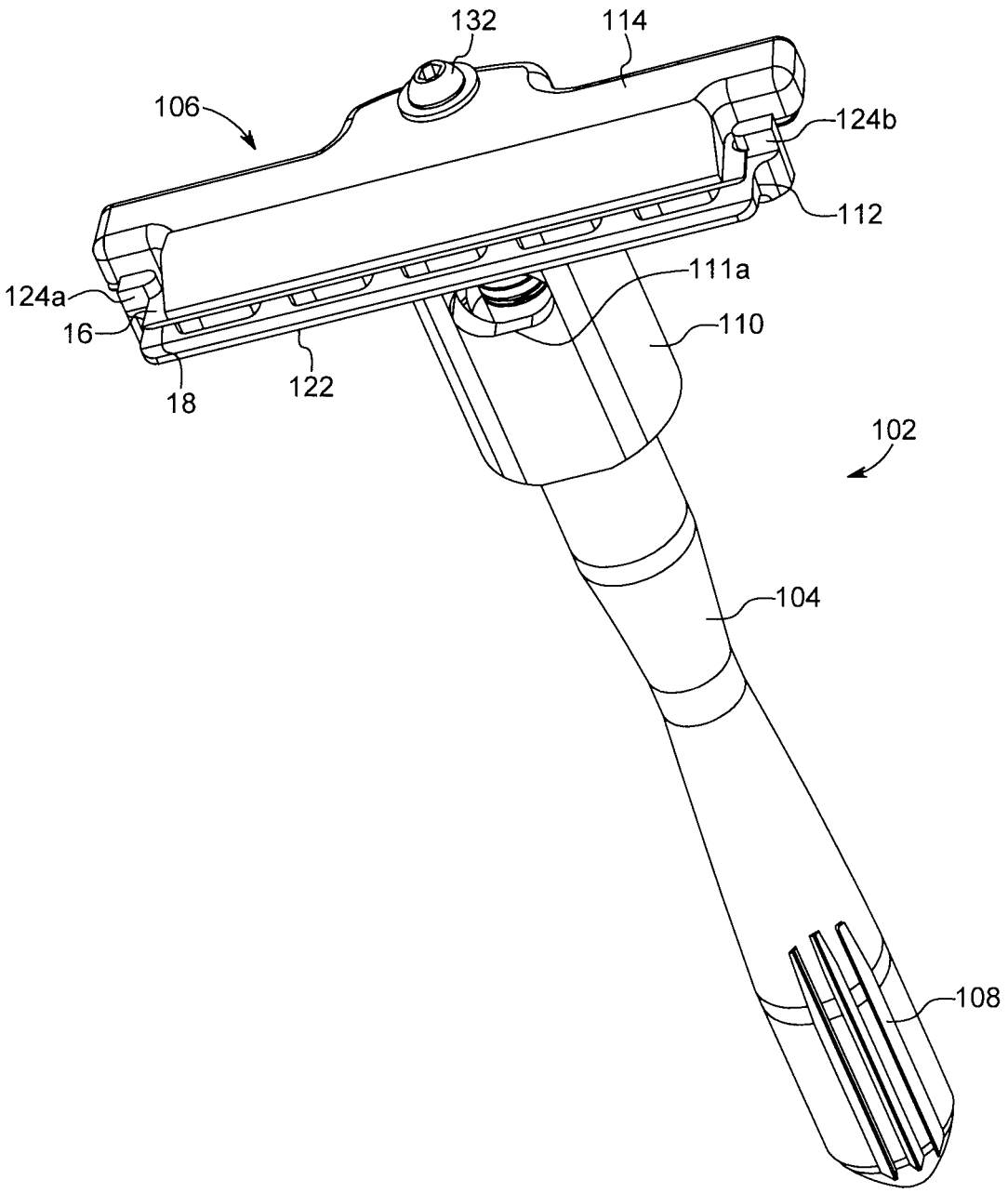
FIG. 15 is a front perspective view of a razor in accordance with one aspect of the present disclosure.
Figure 16:
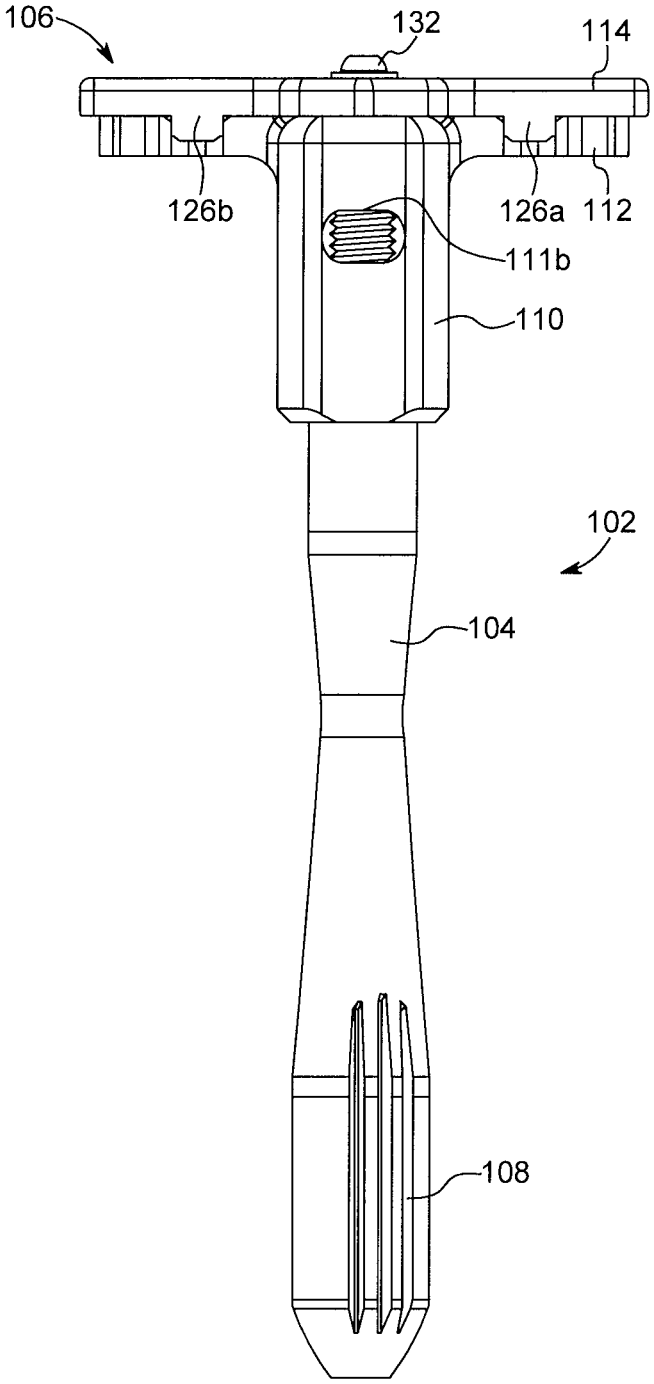
FIG. 16 is a rear view of the razor of FIG. 15.
Figure 17:
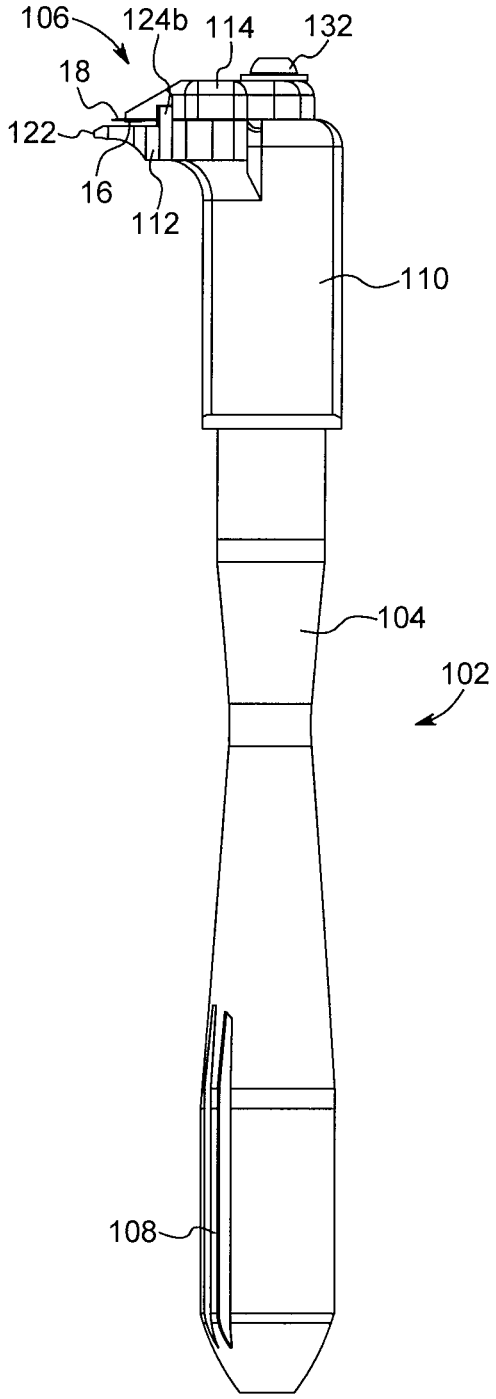
FIG. 17 is a side view of the razor of FIG. 15.
Figure 21:
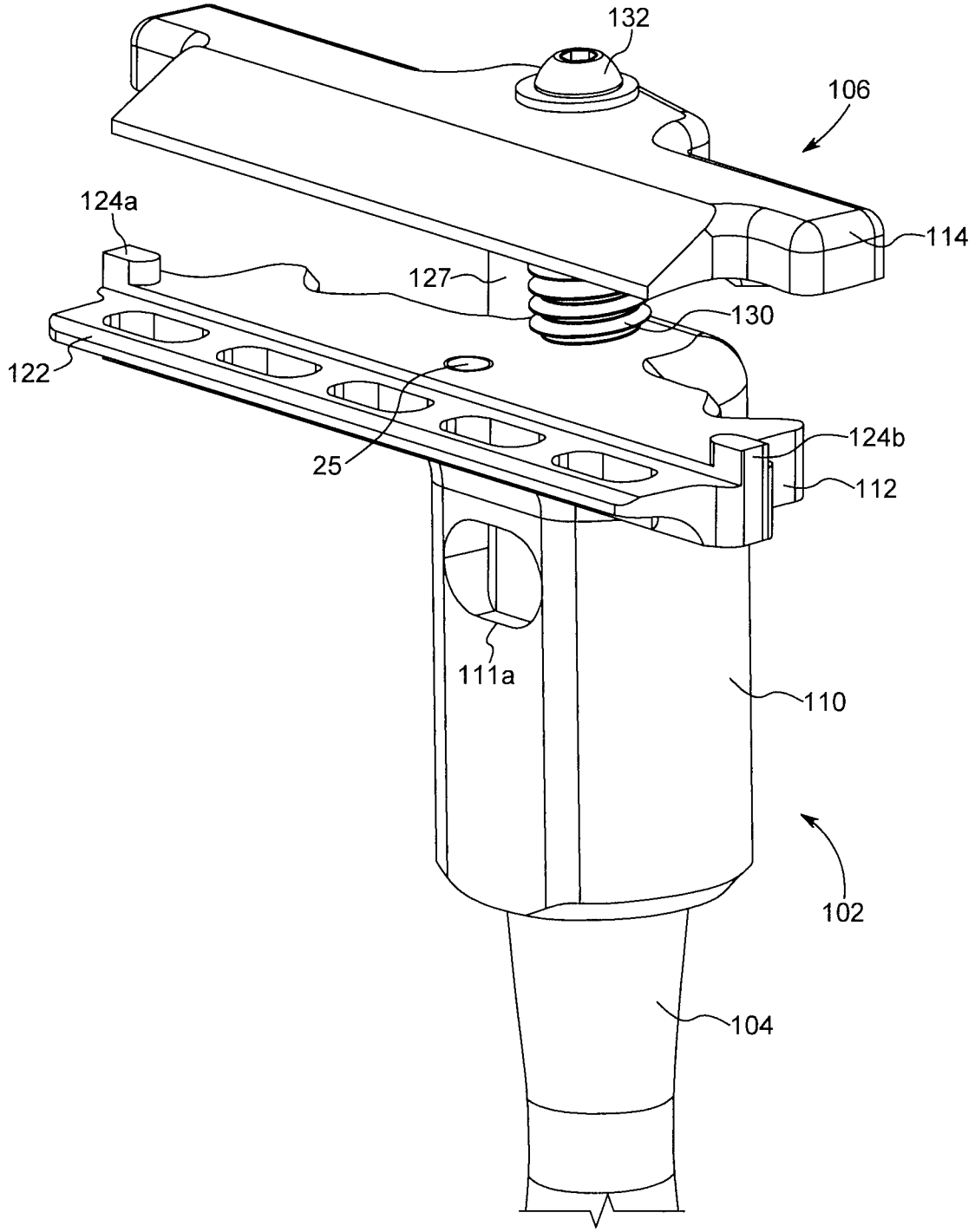
FIG. 21 is a front perspective view of the head of the razor of FIG. 15 with the head in the open position.

With reference to FIG. 15, in one aspect, the head 106 includes a base member 110 operatively connected to the handle 104, as described below, a seat 112 formed on the base member 110, and a cover 114 operatively connected to the base member 110 and the handle 104. The base member 110 is substantially cylindrical and is dimensioned to fit around an outer surface of one end of the handle 104. In one aspect, the inner diameter of the base member 110 is slightly larger than the outer diameter of the end of the handle 104 so that the base member 110 fits around the outer surface of the end of the handle 104. In one aspect, the base member 110 defines a front aperture 111*a* and a rear aperture 111*b* that allows fluid to be flushed or directed out of the base member 110. During use of the razor 102, water or other fluids may leak into the cavity 134 between the bottom end of the base member 110 and the handle 104. This water or fluid can become trapped within the cavity 134 and may create corrosion on the screw member 130. Therefore, by providing the apertures 111*a*, 111*b*, the water or fluid can flush out of the base member 110 without becoming trapped within the cavity 134. The seat 112 is formed on the base member 110 and extends from an upper surface of the base member 110. The seat 112 is configured to receive and hold a razor blade 16 within the razor 102. The seat 112 includes a guard member 122 that extends along the length of a front end of the seat 112. In one aspect, at least two protrusions 124*a*, 124*b* extend from an upper surface of the seat 112. The protrusions 124*a*, 124*b* assist in positioning and retaining the razor blade 16 in a proper orientation on the seat 112. The protrusions 124*a*, 124*b* are positioned on the seat 112 so that the razor blade 16 rests against the protrusions 124*a*, 124*b* and extends from the head 106 to allow shaving with the razor blade 16. The protrusions 124*a*, 124*b* also assist in retaining and holding the razor blade 16 within the head 106 so that the razor blade 16 does not slide out of the head 106. The protrusions 124*a*, 124*b* may constrain the razor blade 16 in two degrees of freedom on the seat 112. As shown in FIG. 21, a magnet 25 may also be provided in an aperture defined in the seat 112 to assist in securing the razor blade 16 within the head 106. The magnet 25 also assists in holding the razor blade 16 to the seat 112 while the user aligns the razor blade 16 with the protrusions 124*a*, 124*b*. Although the use of only one magnet 25 is shown with the razor 102, it is also contemplated that additional magnets may be provided in the seat 112 and/or the cover 114 to assist in holding the razor blade 16 within the head 106.

Figure 19:
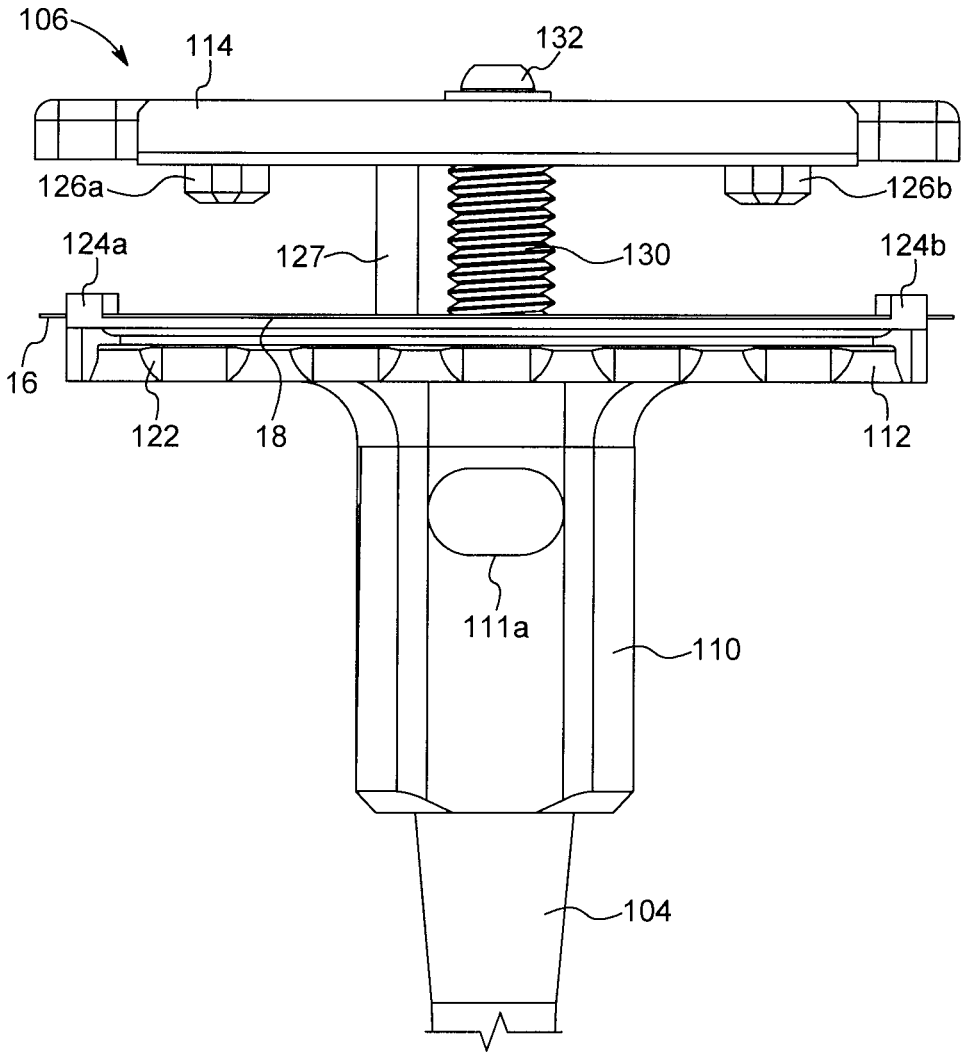
FIG. 19 is a front view of the head of the razor of FIG. 15 with the head in an open position.
Figure 20:
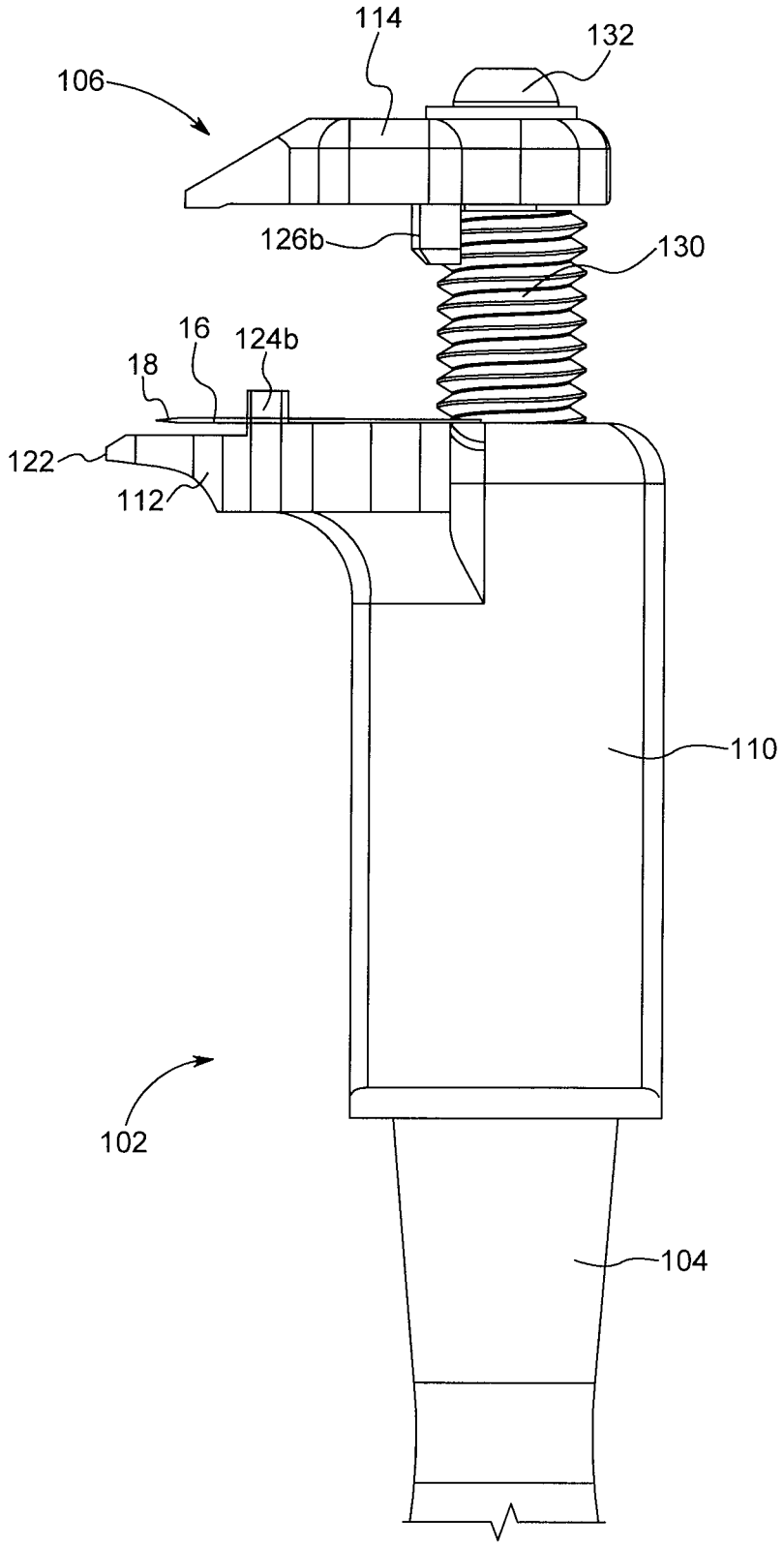
FIG. 20 is a side view of the head of the razor of FIG. 15 with the head in the open position.

With reference to FIGS. 15 and 19, the cover 114 of the head 106 is slidable between an open position and a closed position. In the open position, the cover 114 is positioned for removal and/or insertion of a razor blade 16 within the head 106. In the closed position, the cover 114 is positioned to hold the razor blade 16 within the head 106 to permit a user to shave with the razor 102. The cover 114 extends along the head 106 to substantially cover the razor blade 16 when the razor blade 16 is held within the head 106. In one aspect, the cover 114 includes two extension members 126*a*, 126*b* that extend from a bottom surface of the cover 114 and are received within the seat 112. The extension members 126*a*, 126*b* are slidably positioned within the seat 112 to guide the cover 114 when moving relative to the seat 112. Furthermore, the extension members 126*a*, 126*b* assist in preventing the cover 114 from rotating relative to the seat 112 when the cover 114 is held in the closed position. The cover 114 may also include a dowel pin 127 that is attached to a bottom surface of the cover 114. The dowel pin 127 is slidably received within an aperture defined in a top surface of the base member 110 and prevents the cover 114 from rotating relative to the seat 112 when the cover 114 is moved between the open and closed positions.

Figure 18:
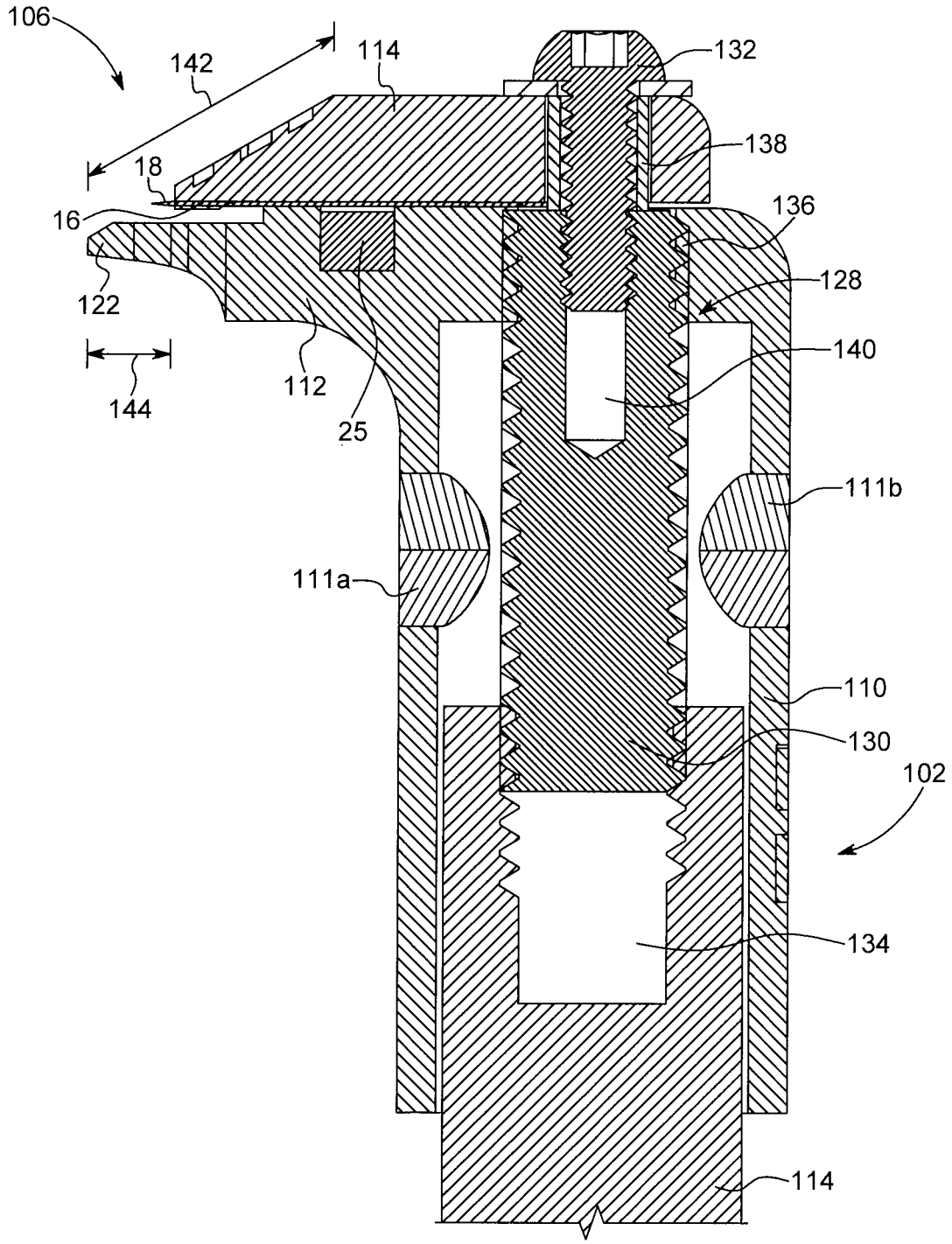
FIG. 18 is a cross-sectional side view of a head of the razor of FIG. 15.

With reference to FIG. 18, an extension arrangement 128 is provided between the cover 114, the base member 110, and the handle 104 to assist in moving the cover 114 relative to the seat 112. The extension arrangement 128 includes a screw member 130 and a fastener 132. One end of the screw member 130 is threaded into and held within the handle 104. The top end of the handle 104 defines a cavity 134 that includes a threaded inner surface to receive one end of the screw member 130. A second end of the screw member 130 is threaded into a threaded aperture 136 defined in the base member 110. The extension arrangement 128 is operatively connected to the cover 114 using the fastener 132. The fastener 132 is inserted through an aperture 138 defined in the cover 114 and received in a cavity 140 defined in the screw member 130. The cavity 140 is defined by an upper end of the screw member 130. The fastener 132 is held in the cavity 140 of the screw member 130 via a friction fit. It is also contemplated that the fastener 132 may be welded or molded within the cavity 140 of the screw member 130. When assembled, the fastener 132 is positioned within the extension arrangement 128 to clamp the cover 114 between the fastener 132 and the base member 110.

With continued reference to FIG. 18, operation of the extension arrangement 128 is described. As the handle 104 is rotated, the screw member 130 moves through the aperture 136 to raise or lower the cover 114 relative to the seat 112. In one aspect, when the handle 104 is rotated in a counterclockwise direction, the screw member 130 is moved upwardly through the aperture 136. The screw member 130 moves upwardly through the aperture 136 until the upper end of the handle 104 contacts the base member 110. Since the cover 114 is clamped between the fastener 132 and the screw member 130, as the screw member 130 moves upwardly through the aperture 136, the cover 114 is also raised upwardly relative to the seat 112. By raising the cover 114 relative to the seat 112, the head 106 is moved to the open position to allow a user to remove and/or insert a razor blade 16 on the seat 112 of the head 106.

In one aspect, as the handle 104 is rotated in a clockwise direction, the screw member 130 is moved downwardly through the aperture 136. The screw member 130 moves downwardly through the aperture 136 until the bottom surface of the cover 114 contacts the base member 110. Since the cover 114 is clamped between the fastener 132 and the screw member 130, as the screw member 130 moves downwardly through the aperture 136, the cover 114 is also moved downwardly relative to the seat 112. By lowering the cover 114 relative to the seat 112, the head 106 is moved to the closed position to clamp the razor blade 16 against the seat 112 within the head 106.

The razor 102 can serve as a trimmer razor that can be used separately from conventional cartridge razors and uses low-cost thin metal blades, such as the double-edged blade. The razor 102 includes a low profile to provide better access to hard-to-reach areas as well as to provide better visualization of where the razor blades 16 will shave on the user's skin surface to produce fine and more accurate shaving lines. Since the razor 102 is decoupled from any other blades used to shave a user's skin surface, the razor blade 16 installed in the razor 102 lasts much longer than traditional trimmer blades incorporated within multi-blade razor cartridges. This longevity of the trimmer razor 102, coupled with the type of blades that are used in the razor 102, provide a low ongoing cost to the user to use such a trimmer razor 102.

Figure 22:
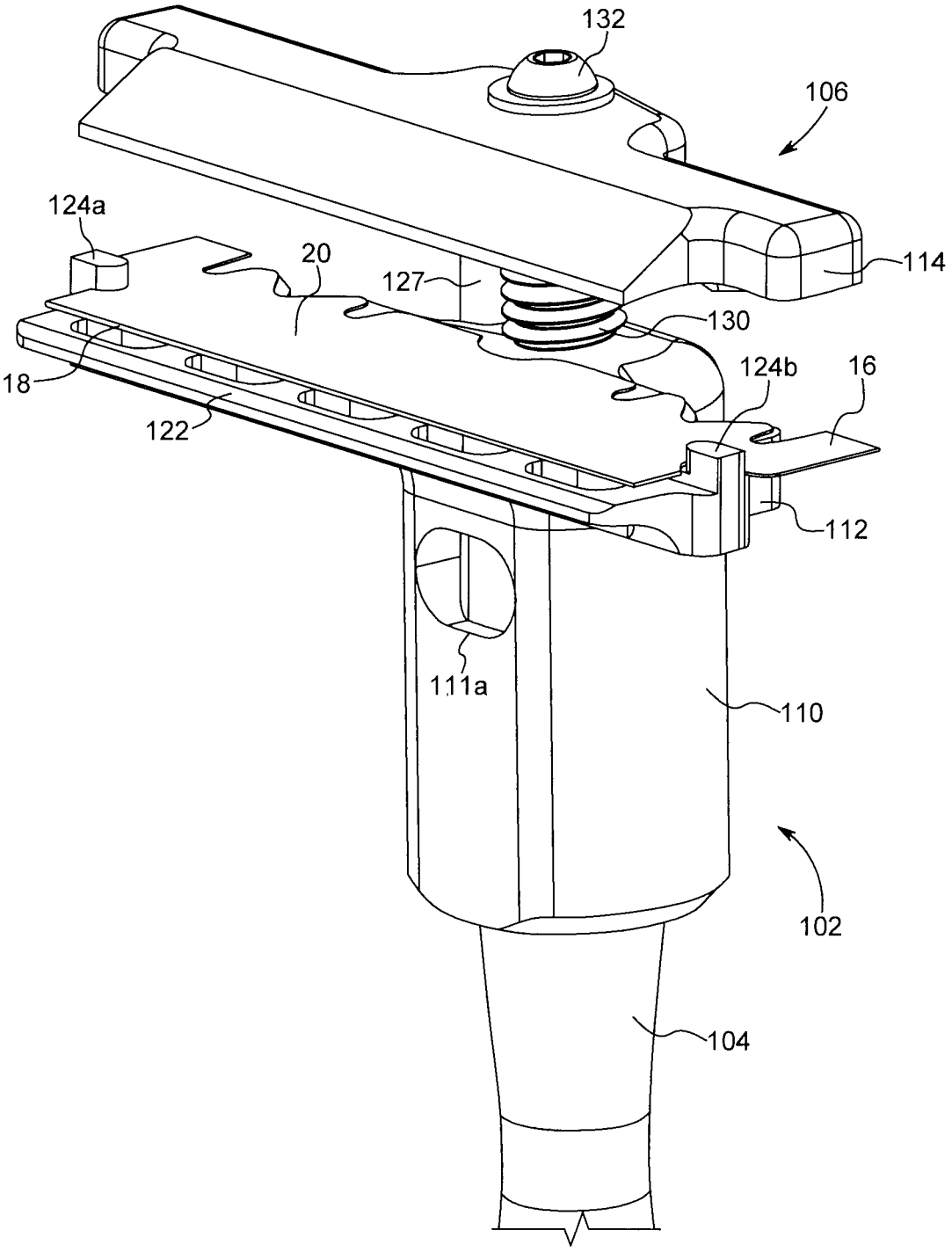
FIG. 22 is a front perspective view of the head of the razor of FIG. 15 with the head in the open position and a razor blade positioned therein.
Figure 23:
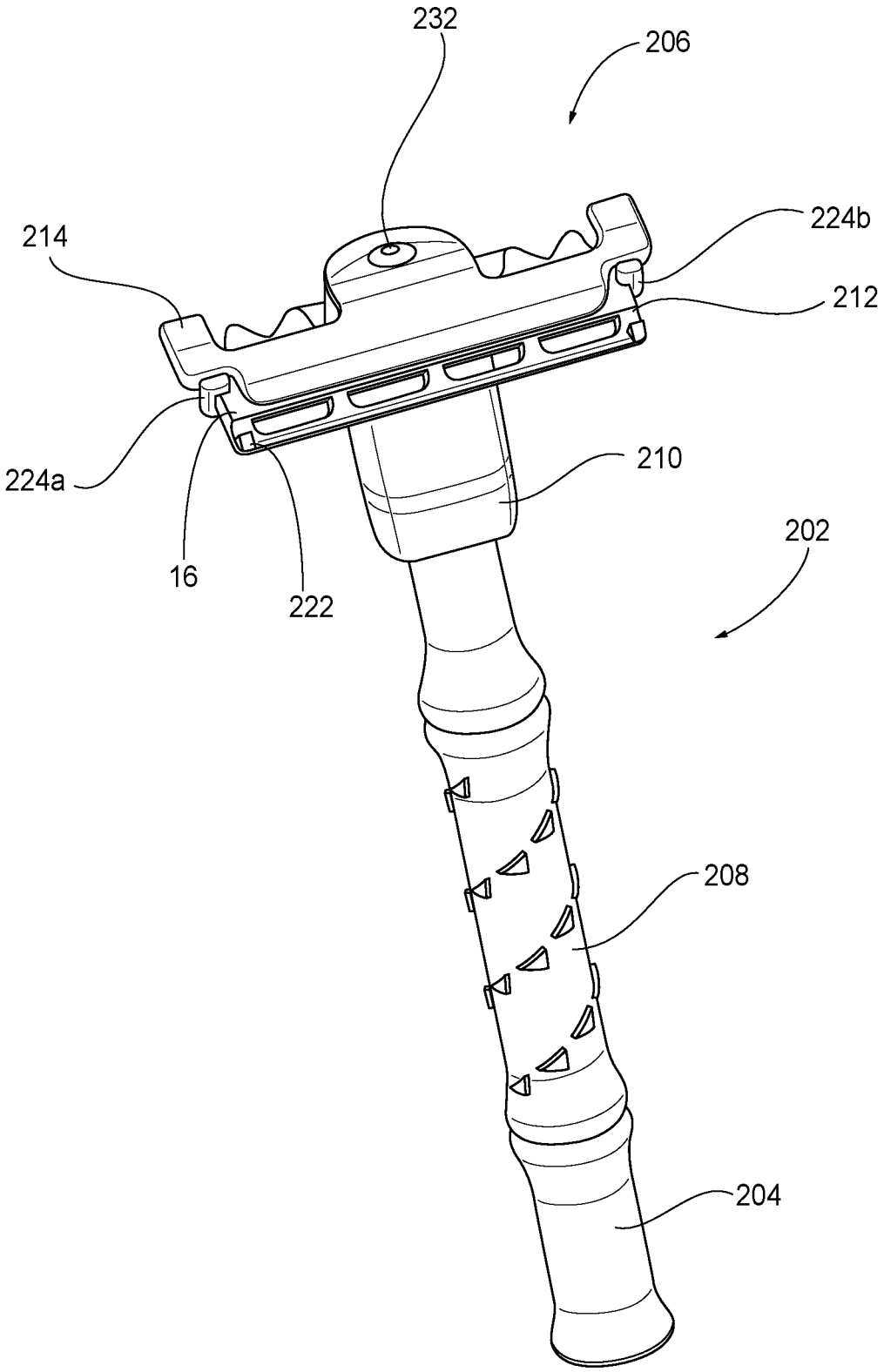
FIG. 23 is a front perspective view of a razor in accordance with another aspect of the present disclosure.
Figure 24:
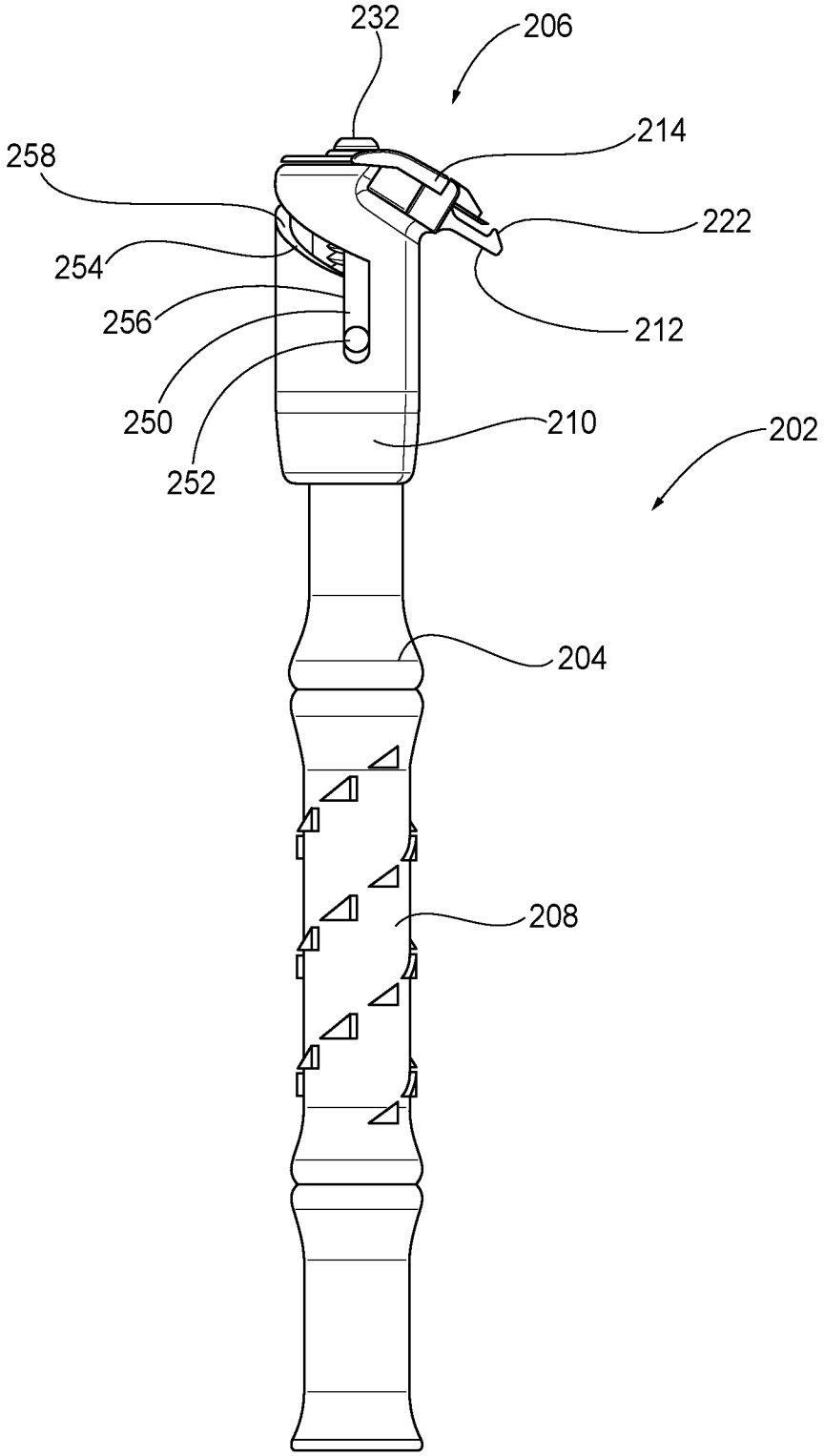
FIG. 24 is a side view of the razor of FIG. 23.

As shown in FIG. 22, the razor 102 accepts the razor blade 16 and places the blade 16 in a precise and repeatable position that allows the user to shave comfortably with the blade 16 in an optimal position for hair removal from the user's skin surface. The outer surface of the cover 114 and the seat 112 create a shave plane 142 (shown in FIG. 18) that is configured to assist the user in positioning the razor 102 in the correct orientation on the user's skin surface. By pressing the shave plane 142 against the user's skin surface, the blade 16 is oriented in a shaving position so that the blade 16 shaves the user's hair. Conventional double-edged razors have a curved shave plane surface, necessitating the need to hold the razor at a precise angle while shaving. Some users find this additional level of control to be difficult and time consuming. The razor 102 of the present disclosure provides a substantially flat or planar shave plane 142 to which the user's skin surface conforms, making the task of holding the razor 102 at the correct angle less important. This makes the use of the razor 102 of the present disclosure easier than the use of conventional double-edged razors and reduces the chances of nicks, cuts, and skin irritation. In one aspect, the seat 112 also provides a shaving gap 144 (shown in FIG. 18) between the leading edge of the cover 114 and the leading edge of the seat 112. The leading edges of the seat 112 and the cover 114 are considered to be the edges of the seat 112 and cover 114 that contact the user's skin surface when using the razor 102. The size of the shaving gap 144 determines the amount of the user's skin surface that is exposed to the razor blade 16 prior to the razor edge 18 of the razor blade 16 contacting the user's skin surface.

With reference to FIGS. 23-27B, in another aspect of the disclosure, a razor 202 includes a handle 204 and a head 206, at least a portion of which is movable about the handle 204. The head 206 includes a base member 210 operatively connected to the handle 204, a seat 212 formed on the base member 210, a cover 214 operatively connected to the base member 210 and the handle 204, and an extension arrangement 228. The handle 204 has a gripping portion 208 configured to provide the ergonomic benefits described above. As will be described below, the extension arrangement 228 facilitates movement of the cover 214 about the handle 204 and relative to the seat 212. As shown, the base member 210 is substantially cylindrical and is dimensioned to fit around an outer surface of one end of the handle 204.

It is contemplated that the base member 210 may take other shapes as long as it remains dimensioned to fit around or engage with the handle 204.

Figure 26A:
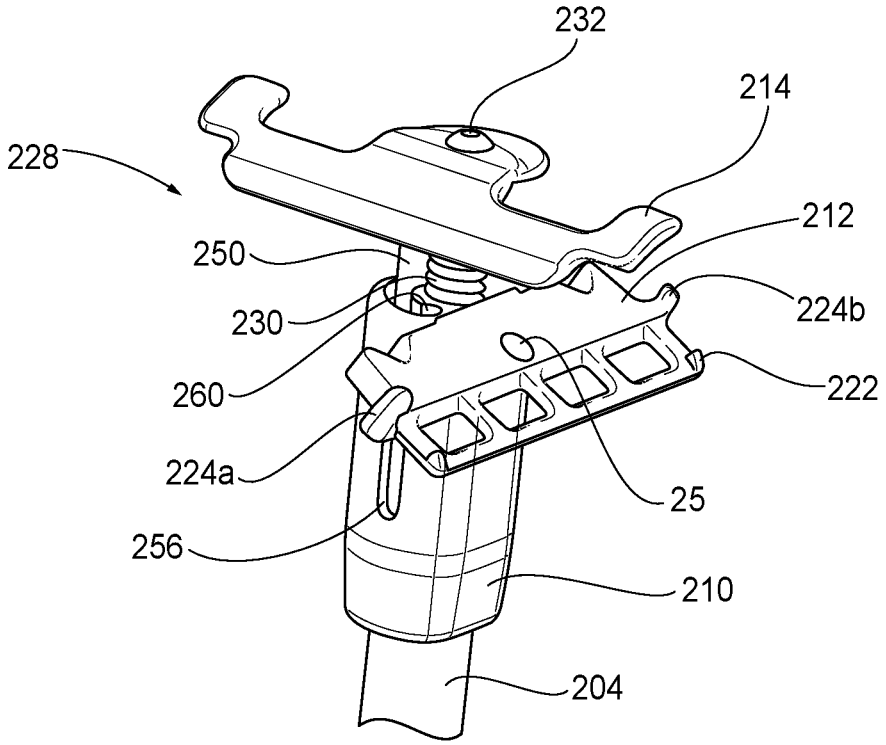
FIG. 26A is a side perspective view of the razor of FIG. 23 as it moves from a closed to an open position.
Figure 26B:
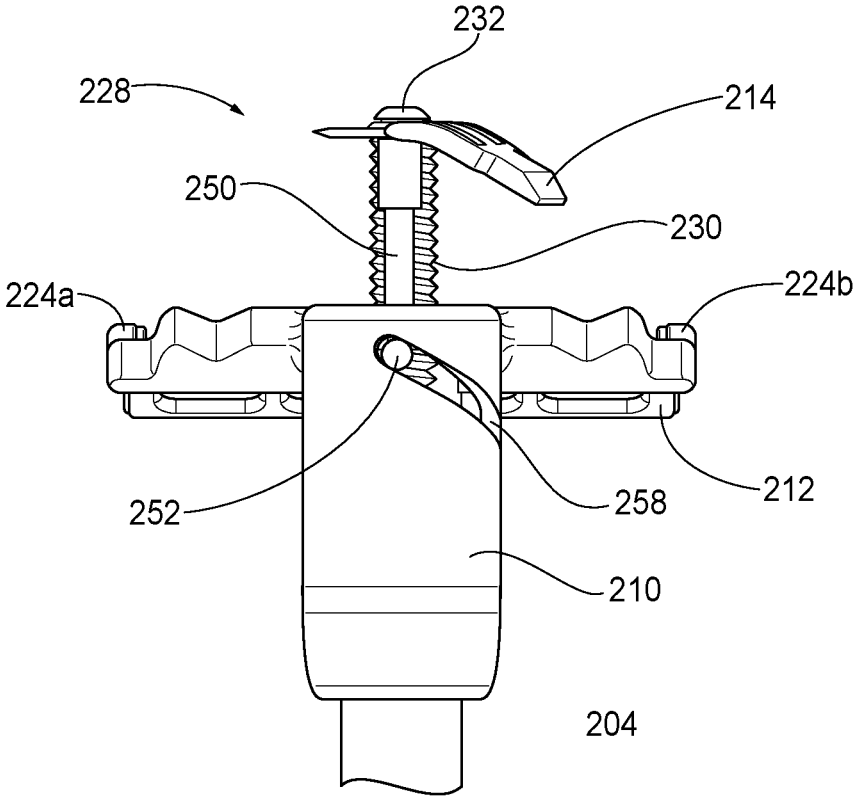
FIG. 26B is a back view of the razor of FIG. 23 in the open position.

The seat 212 is formed on the base member 210 and extends from an upper surface of the base member 210. The seat 212 is configured to receive the razor blade 16 and includes a guard member 222 that extends along the length of a front end of the seat 212. At least two protrusions 224*a*, 224*b* extend from an upper surface of the seat 212 so as to assist in positioning and retaining the razor blade 16 in a proper orientation on the seat 212. The protrusions 224*a*, 224*b* may constrain the razor blade 16 within the head 206 so that the razor blade 16 rests against the protrusions 224*a*, 224*b* to allow shaving with the razor blade 16. As shown in FIG. 26A, a magnet 25 may also be provided in an aperture defined in the seat 12 to assist in securing the razor blade 16 within the head 206. It is contemplated that additional magnets may be provided in the seat 212 and/or the cover 214 to assist in holding the razor blade 16 within the head 206.

With reference to FIGS. 24-27B, the cover 214 is movable between an open position and a closed position. In the open position, shown in FIGS. 26B and 27B, the cover 214 is rotated relative to the seat 212 and positioned for removal and/or insertion of the razor blade 16 within the head 206. In the closed position, shown in FIGS. 24-25B, the cover 214 is positioned to hold the razor blade 16 within the head 206 to permit a user to shave with the razor 202. The extension arrangement 228 is provided between the cover 214, the base member 210, and the handle 204 and facilitates the movement between the opened and closed positions. The extension arrangement 228 includes a screw member 230, a fastener 232, a rod 250 having a cam pin 252, a cam track 254 for receiving the cam pin 252, and an opening 260 on the top of the base member 210. The extension arrangement 228 operates in a manner similar to that discussed above in connection with FIG. 18, but with the additional features of the rod 250, cam pin 252, and cam track 254.

These additional features help to rotate the cover 214 relative to the base member 210 and seat 212, while the other features operate as previously described. The screw member 230 extends through the base member 210 and is received within a cavity defined in the handle 204. The cavity at the end of the handle 204 includes corresponding threads to mate with the screw member 230 that will ultimately allow the cover 214 to rise and twist relative to the seat 212. The fastener 232 is inserted through an aperture defined in the cover 214 and received in a cavity defined in the screw member 230. The fastener 232 is held in the cavity of the screw member 230 via a friction fit, although it is contemplated that the fastener 232 may be welded or molded within the cavity of the screw member 230. The fastener 232 may also be a simple screw that screws into an opening of the screw member 230. In this instance, the fastener 232 would be smaller than the screw member 230. When assembled, the fastener 232 is positioned within the extension arrangement 228 to clamp the cover 214 between the fastener 232 and the base member 210.

Figure 27A:
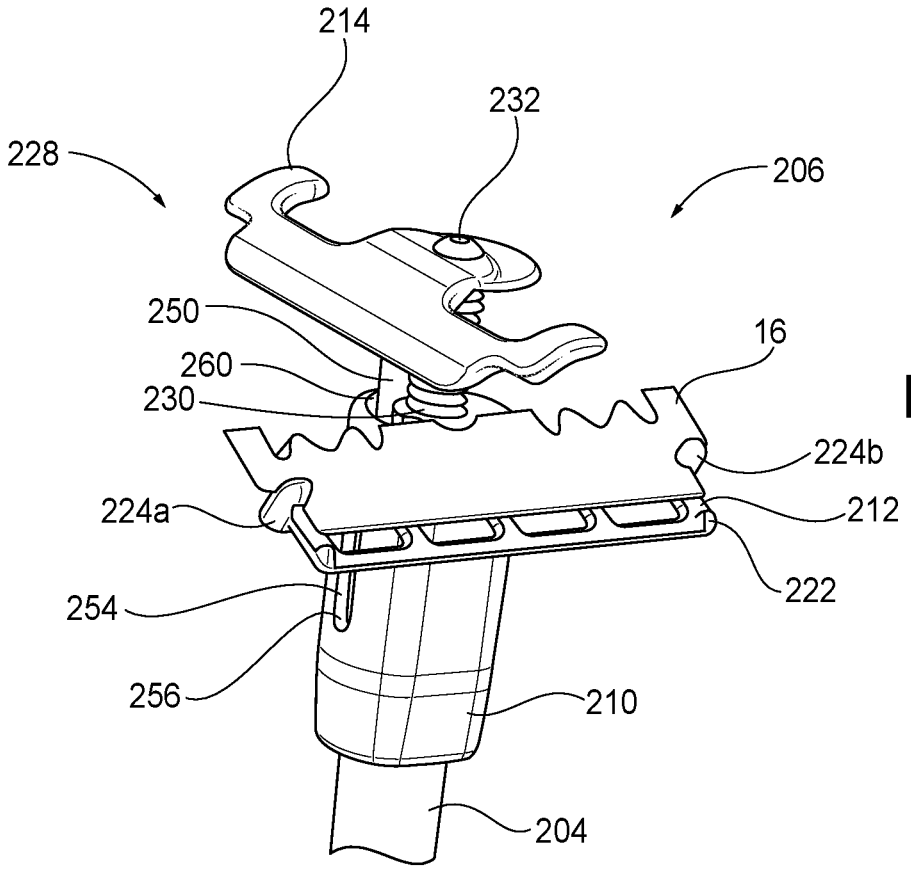
FIG. 27A is a side perspective view of the razor of FIG. 23 with a razor blade thereon as it moves from a closed to an open position.
Figure 27B:
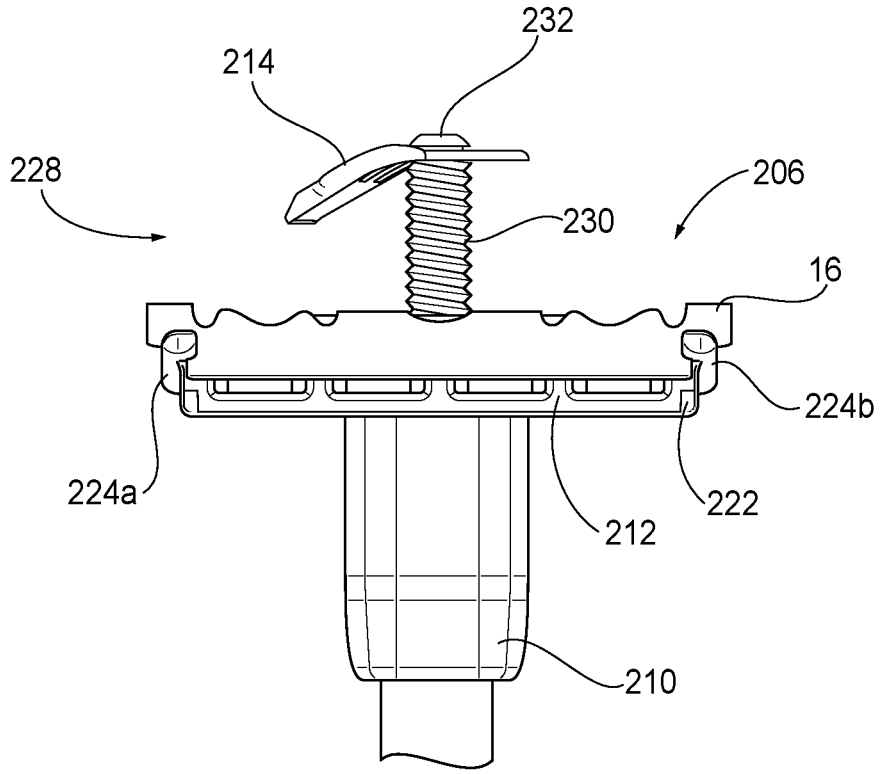
FIG. 27B is a front view of the razor of FIG. 23 in the open position with a razor blade thereon.

With respect to the additional features, the cam track 254 extends along at least one side of the base member 210, and the opening 260 curves around a top end of the base member 210 that is nearest the cover 214. The opening 260 is for slidably receiving the rod 250, and the cam track 254 is for slidably receiving the cam pin 252 which extends outwardly from the rod 250. As shown in FIGS. 26A and 27A, the opening 260 curves around a top end of the base member 210 on the side of the base member 210 so that the rod 250 can curve upwardly and through the base member 210 when the cover 214 is opened. Like the dowel pin 127 discussed above, the rod 250 extends from an underside of the cover 214 in order to extend through the opening 260 and base member 210. The rod 250 may be permanently affixed to the cover 214, or other attachment mechanisms, such as a snap fit or threaded engagement, may be used to connect the rod 250 to the underside of the cover 214.

In the closed position, the screw member 230, rod 250, and cam pin 252 are each held within the base member 210. As stated above, the rod 250 extends from the cover 214 into the base member 210 by way of the opening 260 on the top surface of the base member 210, and the cam pin 252 is confined within and bound by the cam track 254 which extends along an outer surface of the base member 210. The cam track 254 includes a straight portion 256 and a curved portion 258 to guide the cam pin 252, and thus the rod 250, along a path during operation of the extension arrangement 228 and transition of the head 206 from the closed to the open position. In the open position, the screw members 230 and rod 250 are partially or substantially above the base member 210, while the cam pin 252 remains confined by and bound by the cam track 254.

With continued reference to FIGS. 24-27B, operation of the extension arrangement 228 is described. As the handle 204 is rotated, the screw member 230 moves through the aperture to raise or lower the cover 214 relative to the seat 212. In one aspect, when the handle 204 is rotated in a counterclockwise direction, the screw member 230 is twisted and moves upwardly through the aperture within the handle 204 and/or base member 210. Because the cover 214 is clamped between the fastener 232 and the screw member 230, the cover 214 is also raised upwardly relative to the seat 212. The rod 250, connected to the cover 214, moves upwardly as well, and the cam pin 252 moves upwardly with the rod 250 along the straight portion 256 of the cam track 254. As the handle 204 continues to be rotated, the rising cam pin 252 transitions from the straight portion 256 of the cam track 254 to the curved portion 258 of the cam track 254. This transition causes the rod 250 and the cover 214 to turn or rotate relative to the seat 212 while still moving upwardly. The curved portion 258 of the cam track 254 extends along the side of the base member 210 until it stops the cam pin 252 at a position where the rod 250 and cover 214 are rotated, in one example, substantially 90 degrees relative to the seat 212. In one example, the cover 214 rotates about a longitudinal axis of the handle 204. It is also contemplated that the curved portion 258 of the cam track 254 may cause the rod 250 and cover 214 to rotate anywhere between 45 degrees and 135 degrees relative to the seat 212. In other words, the movement of the cover 214 is at least partially restricted by the confinement of the cam pin 252 within the cam track 254. The rotation of the cover 214 relative to the seat 212 results in a majority of the seat 212 and protrusions 224*a*, 224*b* being exposed, thus allowing a user to remove or insert a blade 16 on the seat 212 without the cover 214 interfering.

In another aspect, as the handle 204 is rotated in a clockwise direction, the screw member 230 begins to move downwardly through the aperture. The movement of the extension arrangement 228 is the opposite of the movement described above. As the handle 204 is rotated, the cam pin 252, confined by the curved portion 258 of the cam track 254, curves downwardly along the side of the base member 210 until it reaches the straight portion 256 of the cam track 254. From there, the cam pin 252 continues to move downwardly as the handle 204 is rotated in a clockwise direction. The movement of the cam pin 252 guides the rod 250 along the same curved, downward path, thus rotating the cover 214 back to its original position relative to the seat 212. The clockwise rotation of the handle 204 moves the screw member 230 downwardly through the aperture. Because the cover 214 is clamped between the fastener 232 and the screw member 230, as the screw member 230 moves downwardly, the cover 214 is also lowered downwardly relative to the seat 212 until it is back in the closed position. The closed position allows the cover 214 to clamp the razor blade 16 against the seat 212.

With reference to FIGS. 28-32, another embodiment or aspect of the razor 302 includes an extension arrangement (not numbered) that extends throughout a greater portion of the razor 302. Here, the handle 304 includes a rotatable bottom portion 370 and a top portion 371. The cam pin 352 and cam track 354 are also located on a front side of the razor 302; however, both the cam pin 352 and the cam track 354 may be positioned in different locations relative to the razor 302. The head 306 of the razor 302 may also be a part of the top portion 371 of the razor handle 304, or it may be a separate piece that operatively connects to the top portion 371. This embodiment also lacks the screw members provided in the embodiments described above.

The bottom portion 370 of the handle 304 defines at least a partially hollow interior 372 that receives a threaded bottom portion 374 of a rod 350 therein. The rod 350 extends upwardly from the bottom portion 370 so that the top portion 371 of the handle 304 can fit around the rod 350 and prevent the rod 350 from being exposed. The top portion 371 may engage with the bottom portion 370 via a snap fit, a threaded engagement, or another connection method known to those having skill in the art. The hollow interior 372 of the bottom portion 370 includes a corresponding bore 376 for receiving the threaded bottom portion 374 of the rod 350. The bottom portion 370 of the handle 304 may also include an intermediate element 375 that contains the corresponding bore 376 in order to accept the threaded bottom portion 374.

Figure 28:
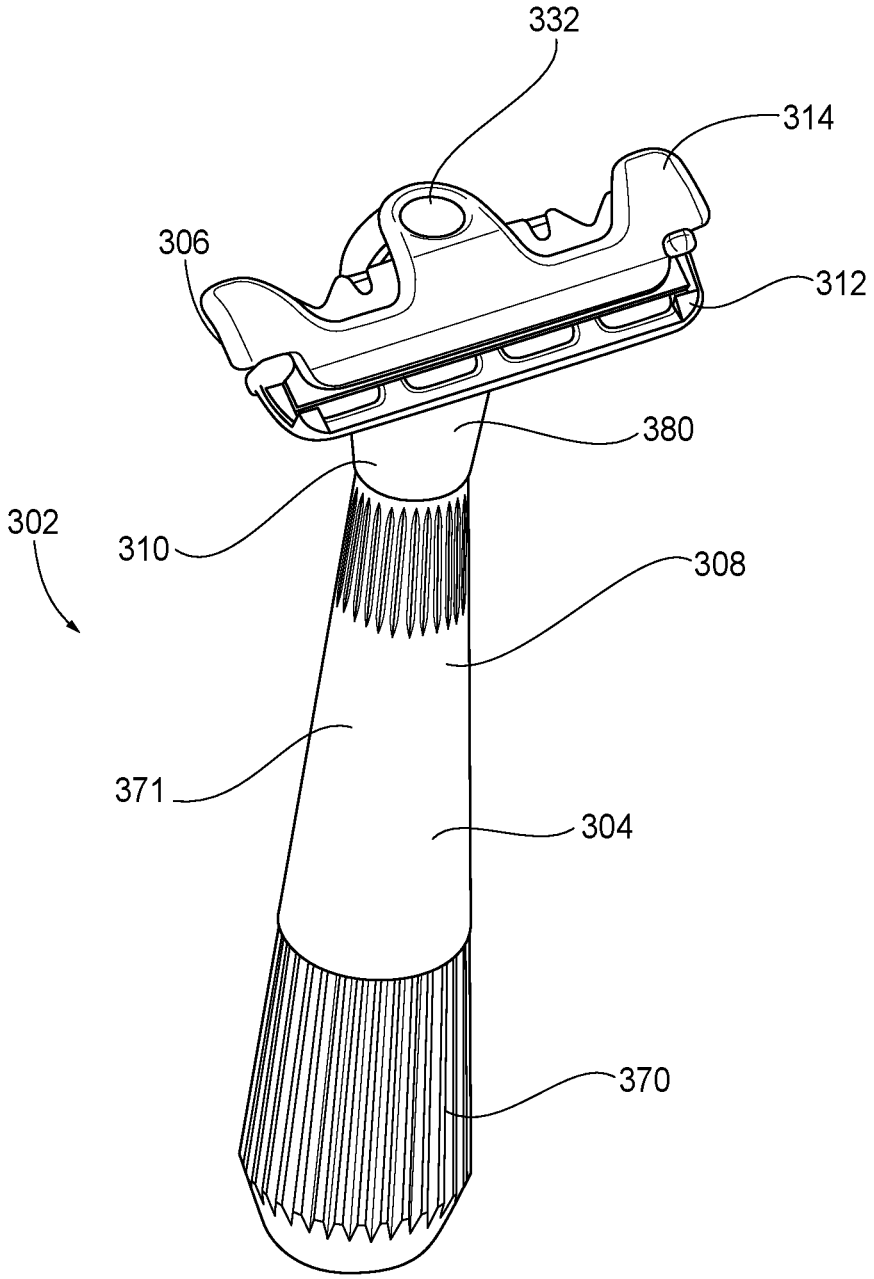
FIG. 28 is a front perspective view of a razor in accordance with another aspect of the present disclosure.
Figure 29:
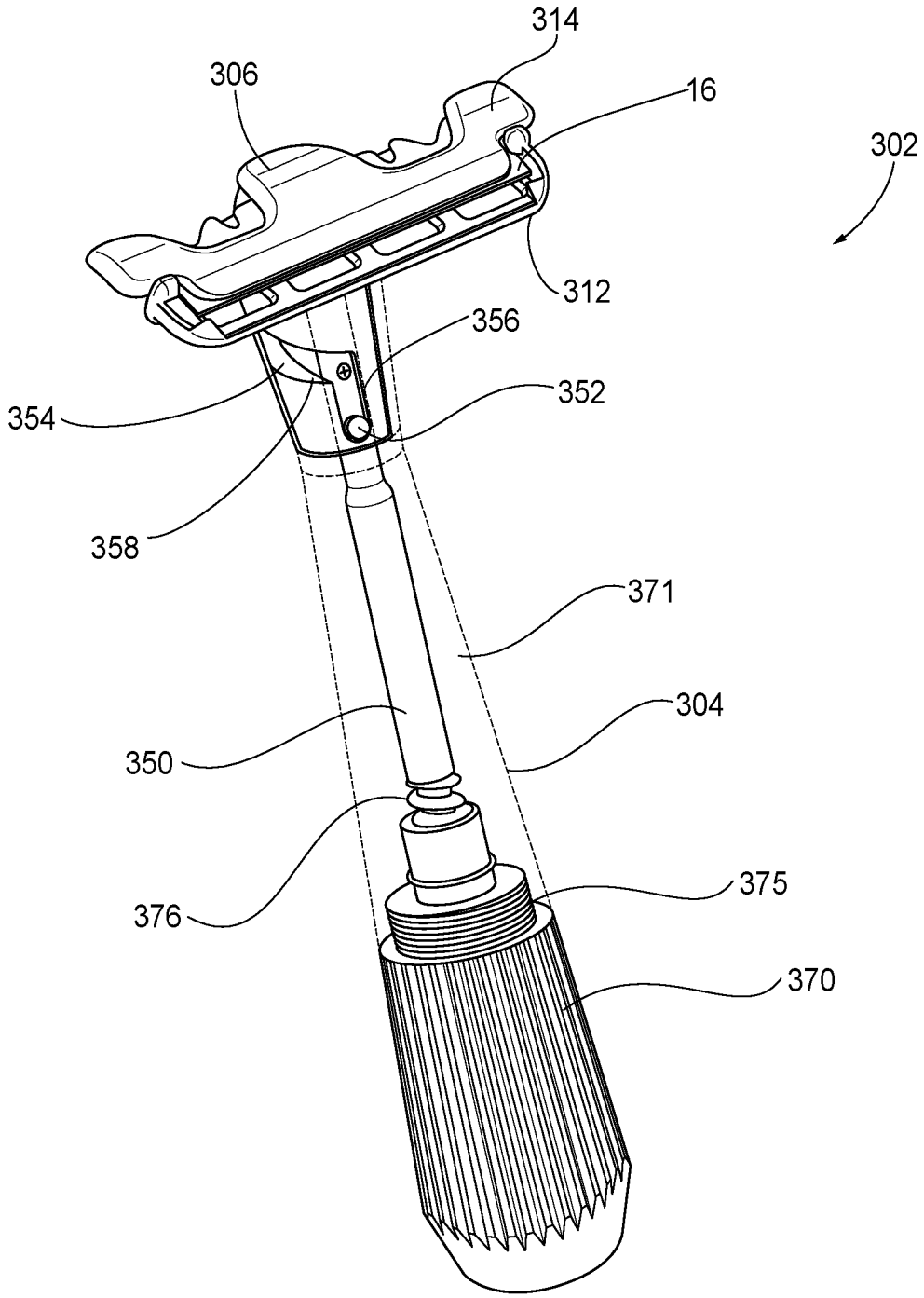
FIG. 29 is partially transparent perspective view of the razor of FIG. 28.
Figure 30:
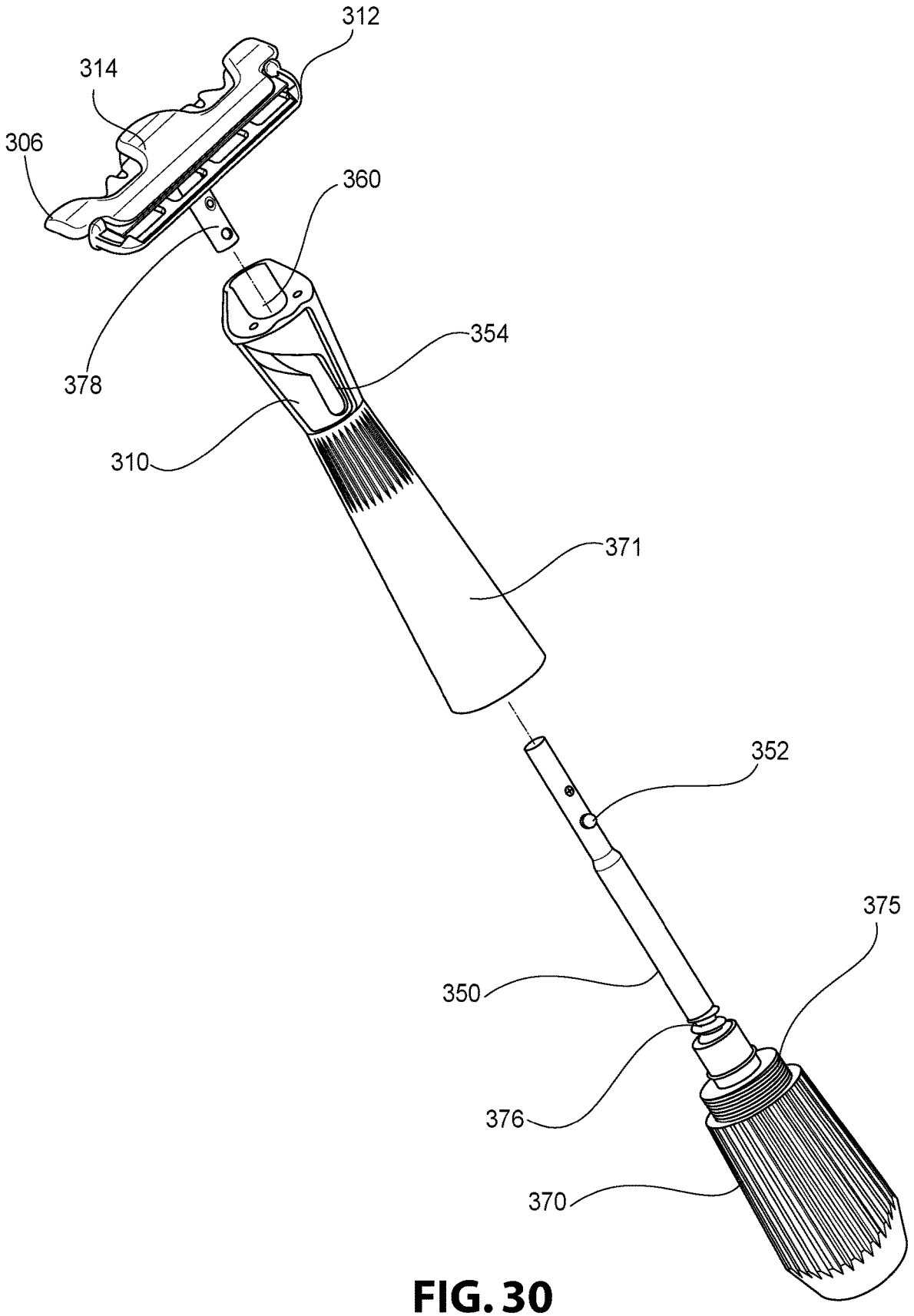
FIG. 30 is a partially exploded view of the razor of FIG. 28.
Figure 31:
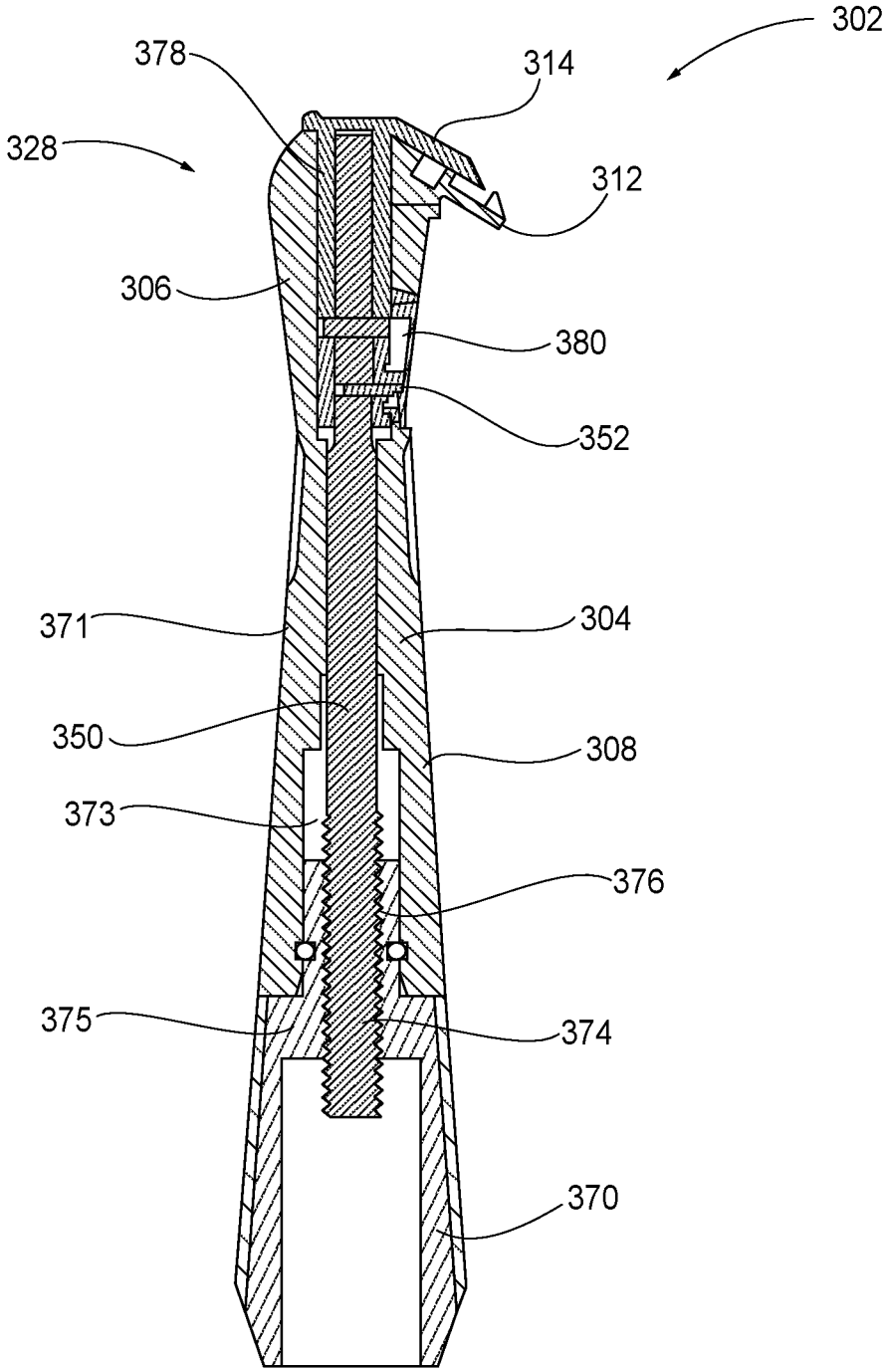
FIG. 31 a cross-sectional side view of the razor of FIG. 28 in the closed position.
Figure 32:
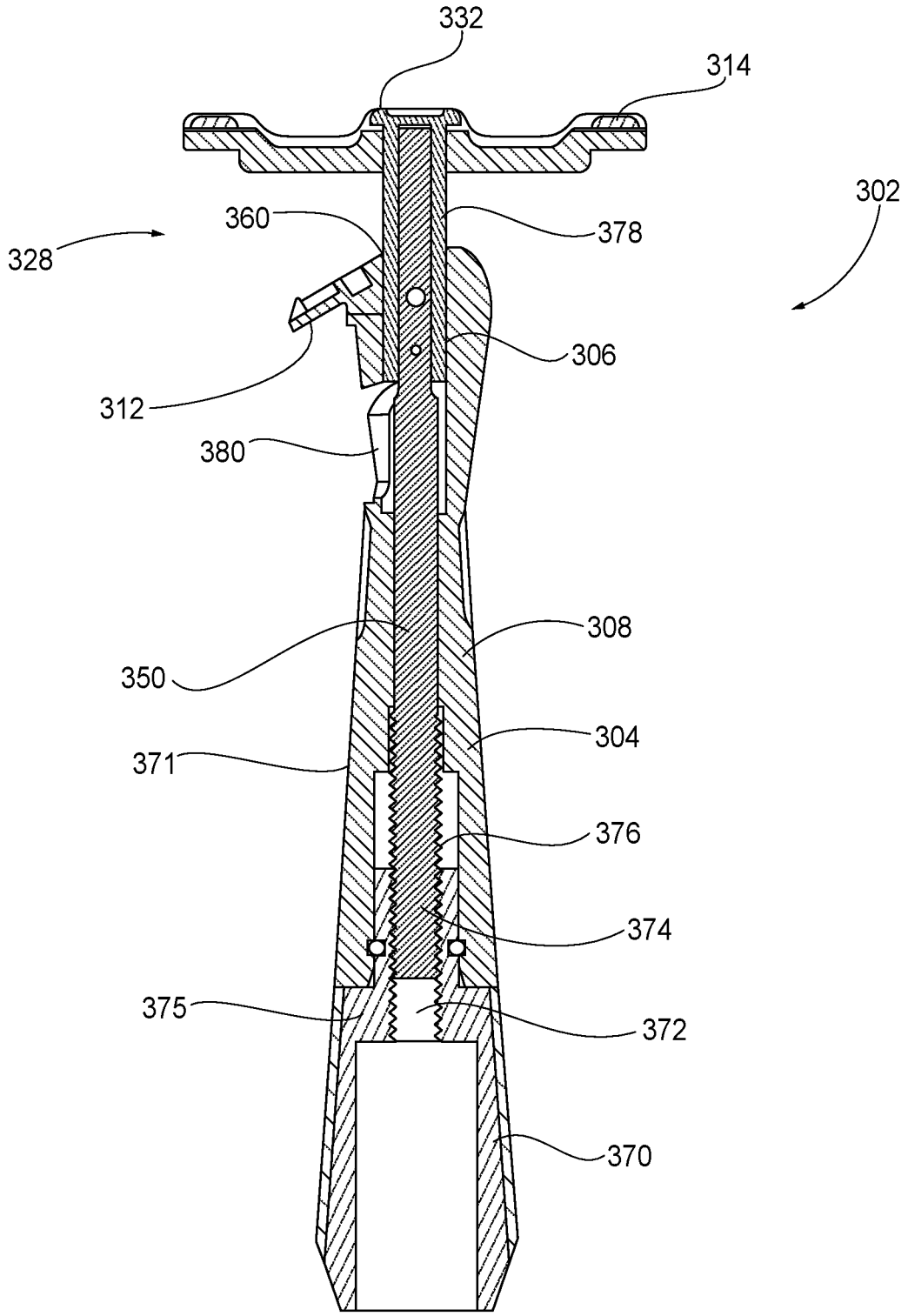
FIG. 32 is a cross-sectional side view of the razor of FIG. 28 in the open position.
Figure 33:
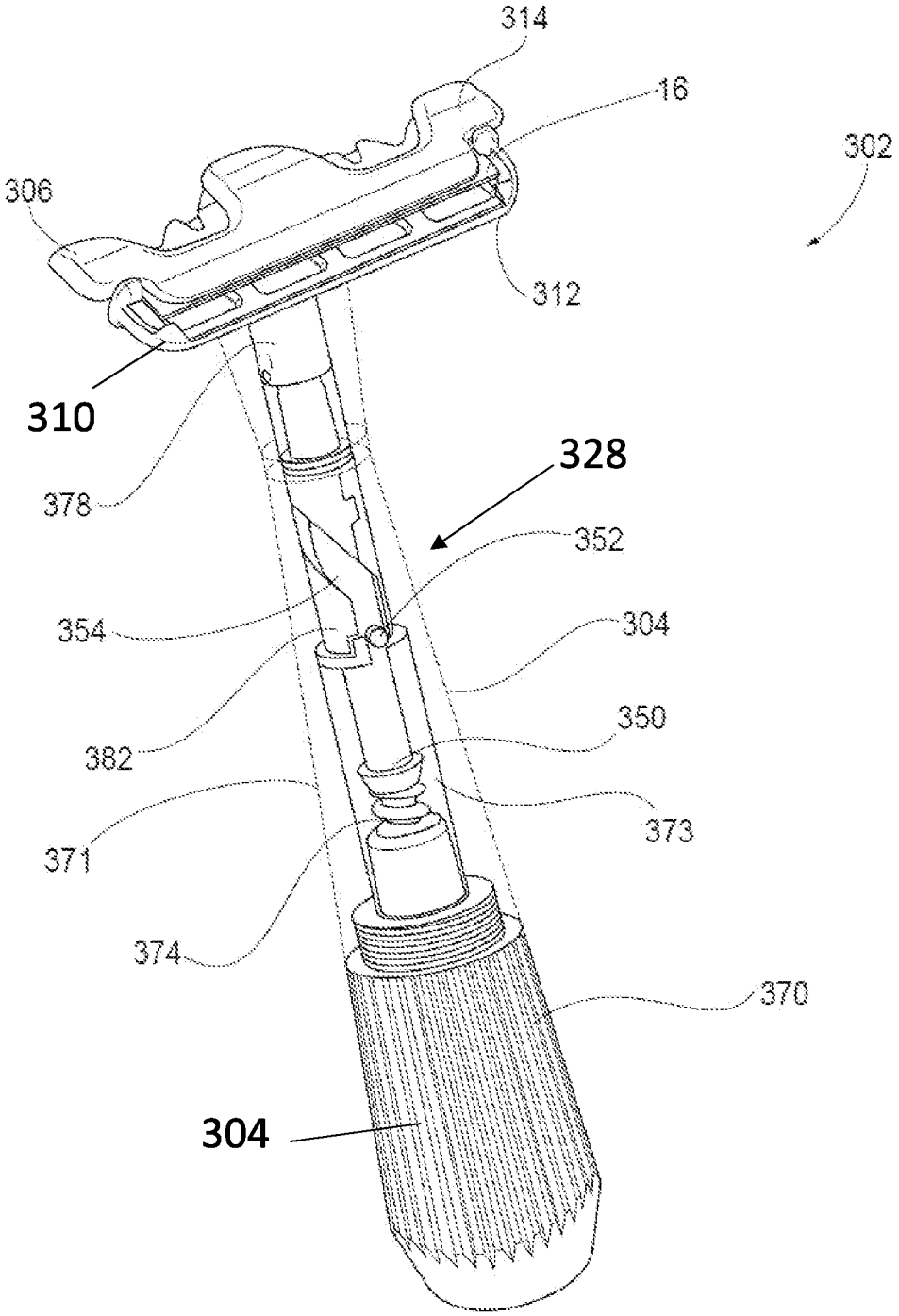
FIG. 33 is a partially transparent perspective view of a razor in accordance with another aspect of the present disclosure.
Figure 34:
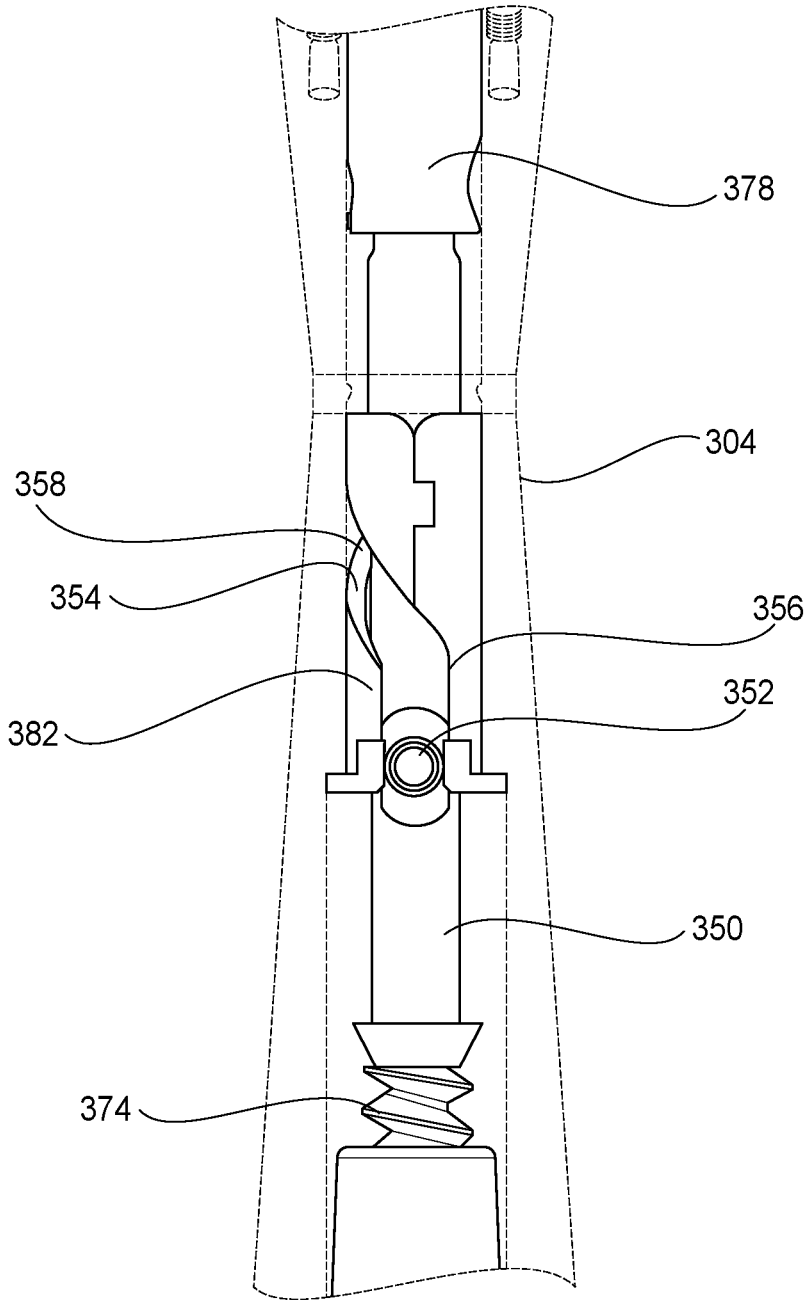
FIG. 34 is a partially transparent partial front view of the razor of FIG. 33.
Figure 35A:
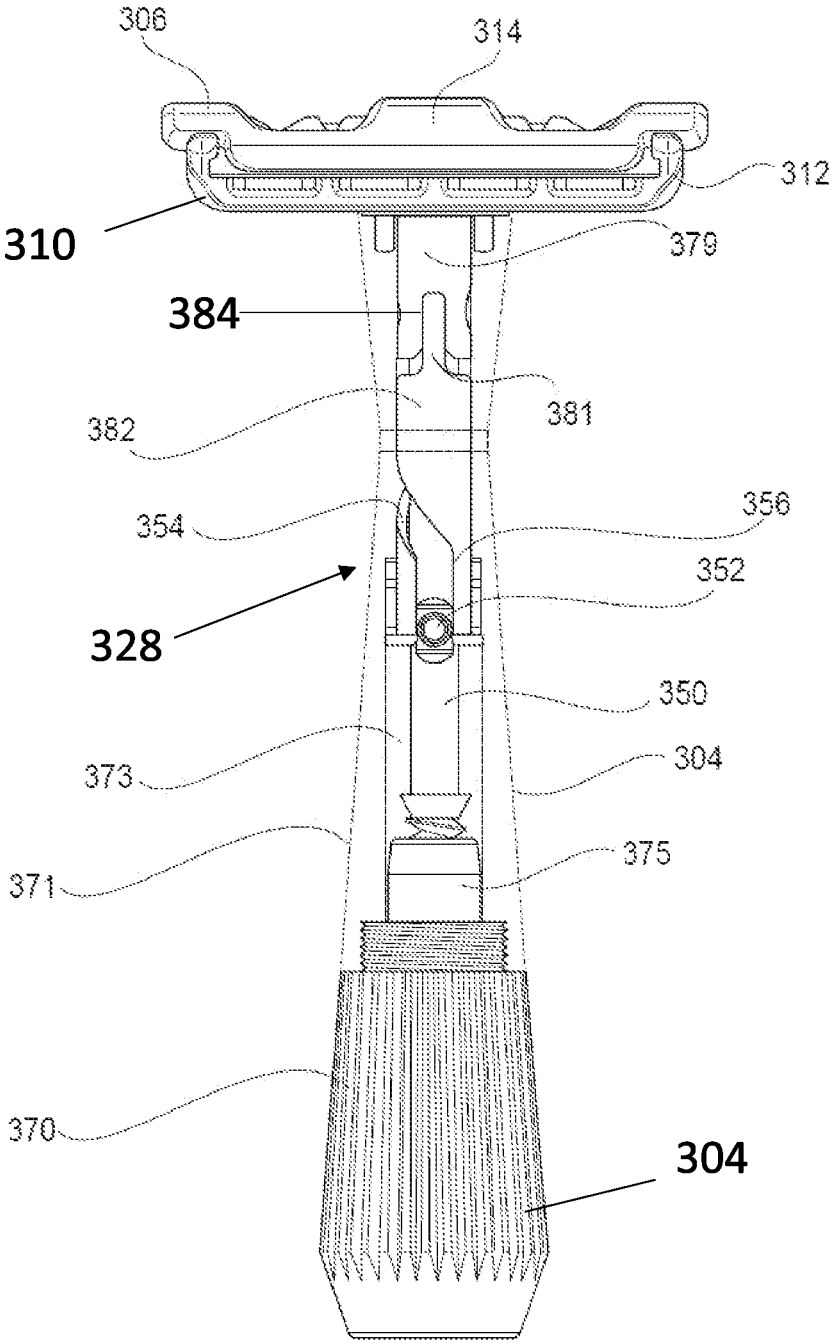
FIG. 35A is a partially transparent front view of the razor of FIG. 33 in the closed position.
Figure 35B:
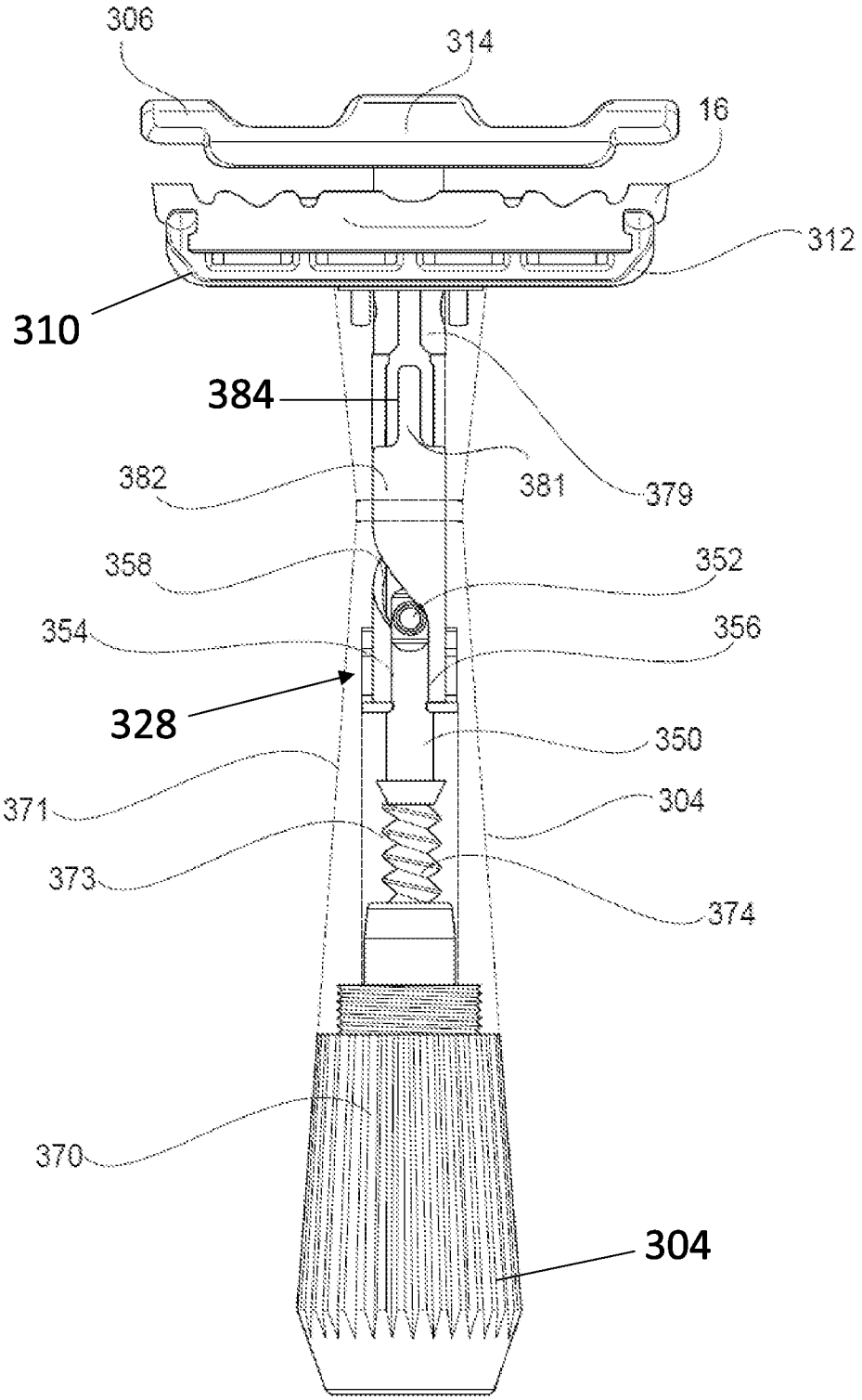
FIG. 35B is partially transparent front view of the razor of FIG. 33 in a partially open position.
Figure 35C:
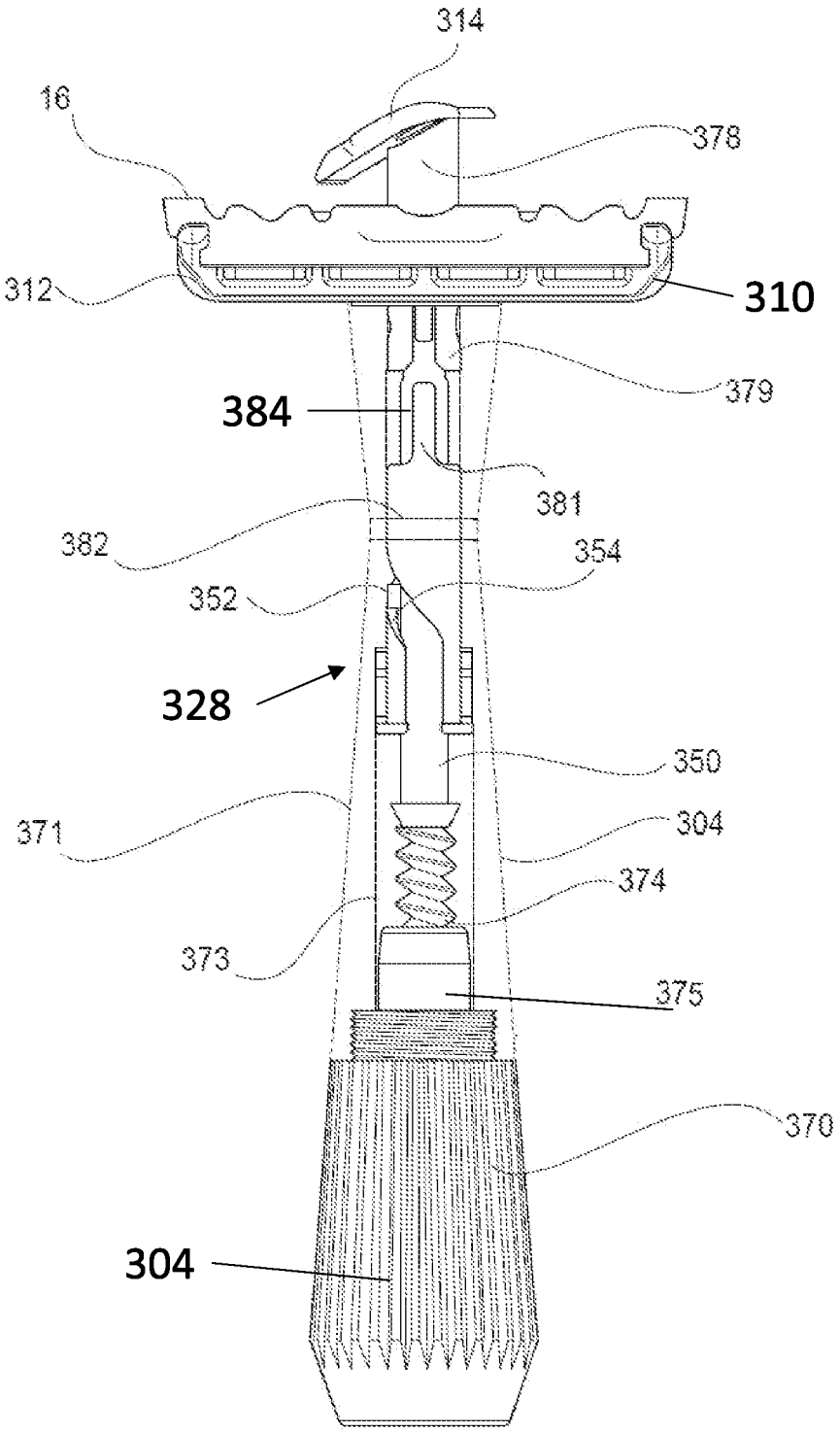
FIG. 35C is a partially transparent front view of the razor of FIG. 33 in an open position.

The top portion 371 of the handle 304 also includes a hollow interior 373 that connects with the hollow interior 372 of the bottom portion and receives the rod 350 therethrough. Ultimately, the rod 350 extends into and is received by a connecting piece 378. The connecting piece 378 extends into the top portion of the handle 304 by way of aperture 360. The connecting piece 378 may be operatively connected to the cover 314 of the head 306 of the razor 302 by way of the fastener 332, as shown in FIG. 28, or the connecting piece 378 may be a part of the cover 314 that extends downwardly into the top portion 371 of the handle 304, as shown in FIGS. 30-32.

Figure 25A:
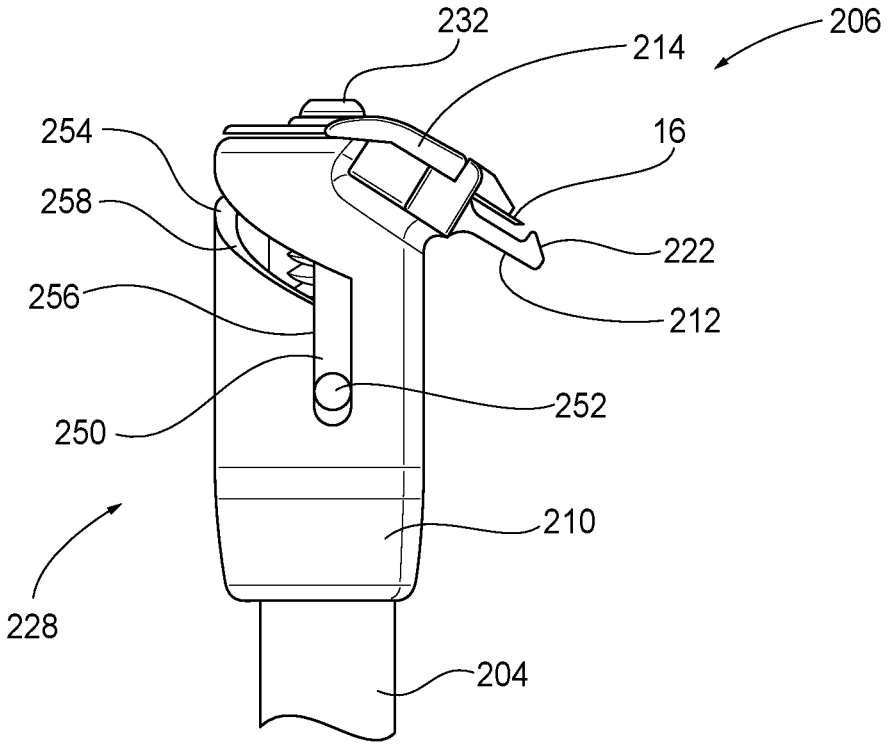
FIG. 25A is a side view of a head of the razor of FIG. 23.
Figure 25B:
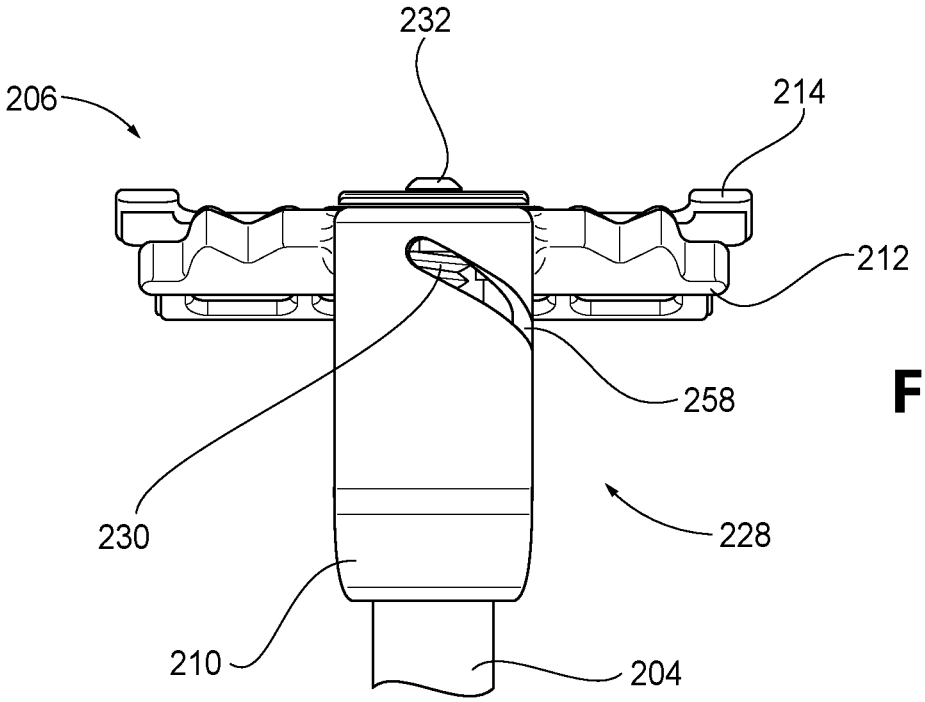
FIG. 25B is a back view of the head of the razor of FIG. 23.

Extending from the rod 350 is a cam pin 352 that travels along a cam track 354, similar to the cam track 254 shown in FIG. 25A. The cam track 354 includes a straight portion 356 extending in the direction of the razor cover 314 and a curved portion 358 curving about the top portion 371 of the handle 304. The cam track 354 partially restricts the movement of the cover 314 by keeping the cam pin 352 confined therein. Restriction of the cover 314 may occur because the cam pin 352 protrudes from the rod 350 and through the connecting piece 378 before fitting within the cam track 354 or because the cam pin 352 only protrudes from the rod 350 and into the cam track 354 while a top portion of the rod 350 above the cam pin 352 is received within the connecting piece 378. The operation of the razor 302 may be similar to the operation described above in connection with razor 202 in FIGS. 23-27B.

In one example, the bottom portion 370 of the handle may be turned in one direction, thus rotating the threaded bottom portion 374 of the rod 350. This rotation causes the threaded bottom portion 374 to operatively move toward the cover 314 in the corresponding bore 376. This raises the rod 350 and cover 314 away from the head 306 of the razor 302 with the rod 350 and connecting piece 378 rising out of the opening 360. The cam pin 352 travels along the curved cam track and causes the cover 314 to turn as the rod 350 continues to travel upwardly. This exposes the razor blade 16 and allows for its replacement on the seat 312. The rotation of the bottom portion 370 of the handle 304 in the opposite direction retracts the cover 314, rod 350, and connecting piece 378 back into the razor 302 in an opposite direction as described above.

In this aspect, it is contemplated that a cover 380 may be operatively connected to the base member 310 to cover the cam pin 352 and cam track 354 in order to prevent the interior of the razor from degrading due to exposure to water, shaving cream, soap, or other fluids. It is further contemplated that other elements such as washers, retaining rings, O-rings, or sealing members can be included within the interior of the handle 304 to facilitate the operation, extension, and retraction of the rod 350, connecting piece 378, and cover 314.

With reference to FIGS. 33-35C, another embodiment or aspect of the razor 302 is shown. This embodiment is similar to that just previously described. The razor 302 includes a razor handle 304 and a head 306, at least a portion of which is movable about the razor handle 304. The head 306 includes a base member 310 operatively connected to the razor handle 304, a seat 312 formed on the base member 310, a cover 314 operatively connected to the base member 310 and the razor handle 304, and an extension arrangement 328. As shown, the base member 310 is substantially cylindrical and is dimensioned to fit around an outer surface of one end of the razor handle 304. It is contemplated that the base member 310 may take other shapes as long as it remains dimensioned to fit around or engage with the razor handle 304. A cam pin 352 is located within the top portion 371 of the razor handle 304 at a location that is closer to the bottom portion 370 of the razor handle 304. On the outside, the bottom portion 370 of the handle 304, top portion 371 of the handle, and head 306 function the same as the embodiment shown in FIGS. 28-32. In other words, as a user twists the lower portion 370 in a first direction, the cover 314 of the razor 302 is configured to raise and twist away from the seat 312 to permit a user to replace the blade 16 sitting thereon. By twisting the gripping portion 370 in the opposite direction, the user may replace the cover 314 on top of the seat 312.

In this embodiment, the rod 350 continues to be received within both portions 370, 371 of the handle 304; however, the cam pin 352 extends through and is restricted by the cam track 354, which is now defined by the hollow interior 373 of the upper portion 371. It is also contemplated that an intermediate piece 382 is received within the hollow interior 373 and defines the cam track 354, including the straight 356 and curved 358 portions to control rotational movement of the rod 350 and ultimately the razor head 314.

This embodiment may also include aligning members 379 that extend from the cover 314 and about the connecting piece 378. The aligning members 379 ensure that the cover 314 is fit properly about the connecting piece 378 as the cover 314 rotates. The aligning members 379 may define at least one alignment member opening 384 that is configured to fit about a flange 381 extending from the connecting piece 378 to further secure the proper alignment.

While aspects of a razor are shown in the accompanying figures and described hereinabove in detail, other aspects will be apparent to, and readily made by, those skilled in the art without departing from the scope and spirit of the invention. Accordingly, the foregoing description is intended to be illustrative rather than restrictive. The invention described hereinabove is defined by the appended claims, and all changes to the invention that fall within the meaning and the range of equivalency of the claims are to be embraced within their scope. It is also contemplated that any feature from one aspect of the disclosure may be incorporated with the features of any other aspect of the disclosure.

The invention claimed is:

1. A trimmer razor comprising:

a handle defining a hollow bore and a cam track therein;

a head, the head comprising a base member, a seat extending from the base member, and a cover, wherein the base member is connected to the handle; and an extension arrangement connecting the cover to the handle so that, upon rotation of the handle relative to the head, the cover is movable between an open position, in which the cover is spaced from the seat, and a closed position, in which the cover is clamped on the seat, wherein the extension arrangement comprises a rod connected to the cover and extending into a hollow bore, the rod comprising a cam pin extending from the rod, wherein the cam pin is configured to follow the cam track so that when the cover moves from the closed position to the open position, the cover rotates relative to the seat, and wherein at least one end of the rod is threaded, and wherein an end of the hollow bore opposing the head defines a thread complimentary to the at least one threaded end of the rod for receiving the at least one threaded end of the rod therein.

2. The trimmer razor as claimed in claim 1, wherein the cover further comprises a connecting piece configured to connect the cover to the rod.

3. The trimmer razor as claimed in claim 2, wherein the cover comprises an alignment member configured to fit about the rod and rotate with the cam pin upon movement of the cover from the closed position to the open position.

4. The trimmer razor as claimed in claim 3, wherein the handle further comprises a track member configured to fit within the hollow bore, the track member defining the cam track.

5. The trimmer razor as claimed in claim 4, wherein the track member comprises at least one alignment flange extending in a direction of the head.

6. The trimmer razor as claimed in claim 5, wherein the alignment member defines an opening configured to receive the at least one alignment flange therein when in the closed position.

* * * * *